US009837090B2

(12) United States Patent
Choo et al.

(10) Patent No.: US 9,837,090 B2
(45) Date of Patent: *Dec. 5, 2017

(54) APPARATUS AND METHOD FOR ENCODING AND DECODING SIGNAL FOR HIGH FREQUENCY BANDWIDTH EXTENSION

(71) Applicant: SAMSUNG ELECTRONICS CO., LTD., Suwon-si (KR)

(72) Inventors: Ki Hyun Choo, Seoul (KR); Eun Mi Oh, Seoul (KR); Ho Sang Sung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 63 days.

This patent is subject to a terminal disclaimer.

(21) Appl. No.: 14/934,969

(22) Filed: Nov. 6, 2015

(65) Prior Publication Data

US 2016/0064013 A1 Mar. 3, 2016

Related U.S. Application Data

(63) Continuation of application No. 13/137,779, filed on Sep. 12, 2011, now Pat. No. 9,183,847.

(30) Foreign Application Priority Data

Sep. 15, 2010 (KR) ..... 10-2010-0090582
Oct. 22, 2010 (KR) ..... 10-2010-0103636
Dec. 29, 2010 (KR) ..... 10-2010-0138045

(51) Int. Cl.
*G10L 19/00* (2013.01)
*G10L 19/12* (2013.01)
(Continued)

(52) U.S. Cl.
CPC ..... *G10L 19/12* (2013.01); *G10L 19/038* (2013.01); *G10L 19/24* (2013.01); *G10L 21/038* (2013.01); *G10L 19/00* (2013.01)

(58) Field of Classification Search
CPC ..... G10L 21/038; G10L 19/038
(Continued)

(56) References Cited

U.S. PATENT DOCUMENTS 6,377,915 B1 4/2002 Sasaki
7,222,069 B2 5/2007 Suzuki et al.
(Continued)

FOREIGN PATENT DOCUMENTS

CN 1954363 A 4/2007
CN 101162584 A 4/2008
(Continued)

OTHER PUBLICATIONS

Communication dated Nov. 4, 2015 by the Japanese Patent Office in Japanese Application No. 2013-529063.
(Continued)

*Primary Examiner* — Daniel Abebe
(74) *Attorney, Agent, or Firm* — Sughrue Mion, PLLC

(57) ABSTRACT

An apparatus and method for encoding and decoding a signal for high frequency bandwidth extension are provided. An encoding apparatus may down-sample a time domain input signal, may core-encode the down-sampled time domain input signal, may transform the core-encoded time domain input signal to a frequency domain input signal, and may perform bandwidth extension encoding using a basic signal of the frequency domain input signal.

11 Claims, 25 Drawing Sheets

(51) Int. Cl.
*G10L 19/24* (2013.01)
*G10L 19/038* (2013.01)
*G10L 21/038* (2013.01)

(58) Field of Classification Search
USPC ..... 704/500
See application file for complete search history.

(56) References Cited

U.S. PATENT DOCUMENTS

| | | | |
|---|---|---|---|
| 7,668,711 | B2 | 2/2010 | Chong et al. |
| 7,742,629 | B2 | 6/2010 | Zarkh et al. |
| 7,873,514 | B2 | 1/2011 | Ramprashad |
| 8,463,602 | B2 | 6/2013 | Oshikiri |
| 8,639,500 | B2 | 1/2014 | Choo et al. |
| 8,990,075 | B2 | 3/2015 | Oh et al. |
| 2006/0031075 | A1 | 2/2006 | Oh et al. |
| 2006/0149538 | A1 | 7/2006 | Lee et al. |
| 2007/0282599 | A1 | 12/2007 | Choo et al. |
| 2008/0071550 | A1 | 3/2008 | Oh et al. |
| 2008/0120117 | A1 | 5/2008 | Choo et al. |
| 2008/0262835 | A1 | 10/2008 | Oshikiri |
| 2008/0270125 | A1 | 10/2008 | Choo et al. |
| 2009/0234645 | A1 | 9/2009 | Bruhn |
| 2010/0010809 | A1 | 1/2010 | Oh et al. |
| 2010/0063810 | A1 | 3/2010 | Gao |
| 2010/0305956 | A1 | 12/2010 | Oh et al. |
| 2011/0257980 | A1* | 10/2011 | Gao ..... G10L 21/038 704/500 |
| 2011/0257984 | A1 | 10/2011 | Virette et al. |
| 2012/0158409 | A1 | 6/2012 | Nagel et al. |
| 2012/0239391 | A1 | 9/2012 | Duwenhorst et al. |
| 2013/0246075 | A1 | 9/2013 | Oshikiri |
| 2014/0207445 | A1* | 7/2014 | Gao ..... G10L 19/005 704/220 |
| 2014/0372108 | A1 | 12/2014 | Choo et al. |

FOREIGN PATENT DOCUMENTS

| | | | |
|---|---|---|---|
| CN | 101183527 | A | 5/2008 |
| CN | 101236745 | A | 8/2008 |
| CN | 101568959 | A | 10/2009 |
| CN | 101681623 | A | 3/2010 |
| JP | 2002-202799 | A | 7/2002 |
| JP | WO2005/104094 | A1 | 11/2005 |
| JP | 2006-48043 | A | 2/2006 |
| JP | 2006-189836 | A | 7/2006 |
| JP | 2008-96567 | A | 4/2008 |
| JP | 2010500819 | A | 1/2010 |
| KR | 10-2007-0115637 | A | 12/2007 |
| KR | 10-2008-0045047 | A | 5/2008 |
| KR | 10-2008-0066473 | A | 7/2008 |
| KR | 10-2010-0095585 | A | 8/2010 |
| WO | 2008/084924 | A1 | 7/2008 |
| WO | 2009/066959 | A1 | 5/2009 |
| WO | 2010003564 | A1 | 1/2010 |
| WO | 2010/066158 | A1 | 6/2010 |

OTHER PUBLICATIONS

Communication dated Jul. 26, 2016, issued by the Japanese Patent Office in counterpart Japanese Patent Application No. 2013-529063.
Communication dated Oct. 19, 2016, issued by the European Patent Office in counterpart European Patent Application No. 16172268.1.
Communication dated Jul. 29, 2014 issued by the European Patent Office in counterpart European Patent Application No. 11825447.3.
Communication dated Jul. 30, 2015 by The State Intellectual Property Office of PR China in related Application No. 201180054965.3.
Communication dated May 19, 2015 by the Japanese Patent Office in related Application No. 2013-529063.
Mao-Shen et al., "8.64kbit/s Super-wideband Embedded Speech and Audio Coding Algorithm", Journal on Communications. vol. 30, No. 5, May 31, 2009, 10 total pages.
Masahiro Oshikiri et al.; "Efficient Spectrum Coding for Super-Wideband Speech and Its Application to Jul. 10, 2015 KHz Bandwidth Scalable Coders"; Acoustics, Speech, and Signal Processing; IEEE International Conference on Montreal; vol. 1; May 17, 2004; pp. 481-484; XP010717670; DOI: 10.1109/ICASSP.2004.1326027.
Oshikiri et al., "A 7/10/15kHz Handwidth Scalable Speech Coder Using Pitch Filtering Based Spectrum Coding", The Institute of Electronics, Information and Communication Engineers, J89-D, No. 2, Feb. 1, 2006, 12 total pages.
International Search Report dated Apr. 24, 2012 in corresponding International Patent Application PCT/KR2011/006819.
Communication dated Feb. 27, 2017, issued by the Korean Intellectual Property Office in counterpart Korean Application No. 10-2010-0138045.

* cited by examiner

APPARATUS AND METHOD FOR ENCODING AND DECODING SIGNAL FOR HIGH FREQUENCY BANDWIDTH EXTENSION

CROSS-REFERENCE TO RELATED APPLICATIONS

This application is a continuation of U.S. application Ser. No. 13/137,779, filed on Sep. 12, 2011, which claims the benefit of Korean Patent Application No. 10-2010-0090582, filed on Sep. 15, 2010, Korean Patent Application No. 10-2010-0103636, filed on Oct. 22, 2010, and Korean Patent Application No. 10-2010-0138045, filed on Dec. 29, 2010 in the Korean Intellectual Property Office, the disclosures of which are incorporated herein by reference.

BACKGROUND

1. Field

One or more example embodiments of the following description relate to a method and apparatus for encoding or decoding an audio signal such as a speech signal or a music signal, and more particularly, to a method and apparatus for encoding or decoding a signal corresponding to a high-frequency domain among audio signals.

2. Description of the Related Art

A signal corresponding to a high-frequency domain is less sensitive to a fine structure of a frequency than a signal corresponding to a low-frequency domain. Accordingly, there is a need to increase an encoding efficiency to overcome a restriction of bits available when encoding an audio signal. Thus, a large number of bits may be allocated to a signal corresponding to a low-frequency domain, while a smaller number of bits may be allocated to a signal corresponding to a high-frequency domain.

Such a scheme may be applied to a Spectral Band Replication (SBR) technology. SBR technology may be used to improve encoding efficiency by representing high-band component signals as an envelope, and by synthesizing the high-band component signals during the decoding of the high-band component signals, based on a fact that an auditory sense of a human being has a relatively low resolution in a high-band signal.

In SBR technology, there is a demand for an improved method for extending a bandwidth of a high-frequency domain.

SUMMARY

The foregoing and/or other aspects are achieved by providing an encoding apparatus including a down-sampling unit to down-sample a time domain input signal, a core-encoding unit to core-encode the down-sampled time domain input signal, a frequency transforming unit to transform the core-encoded time domain input signal to a frequency domain input signal, and an extension encoding unit to perform bandwidth extension encoding using a basic signal of the frequency domain input signal.

The extension encoding unit may include a basic signal generator to generate the basic signal of the frequency domain input signal, using a frequency spectrum of the frequency domain input signal, a factor estimator to estimate an energy control factor using the basic signal, an energy extractor to extract an energy from the frequency domain input signal, an energy controller to control the extracted energy using the energy control factor, and an energy quantizer to quantize the controlled energy.

The basic signal generator may include an artificial signal generator to generate an artificial signal corresponding to a high-frequency section by copying and folding a low-frequency section of the frequency domain input signal, an envelope estimator to estimate an envelope of the artificial signal using a window, and an envelope applier to apply the estimated envelope to the artificial signal. Applying the estimated envelope means that the artificial signal is divided by the estimated envelope of the artificial signal.

The factor estimator may include a first tonality calculating unit to calculate a tonality of a high-frequency section of the frequency domain input signal, a second tonality calculating unit to calculate a tonality of the basic signal, and a factor calculating unit to calculate the energy control factor using the tonality of the high-frequency section and the tonality of the basic signal.

The foregoing and/or other aspects are also achieved by providing an encoding apparatus including a down-sampling unit to down-sample a time domain input signal, a core-encoding unit to core-encode the down-sampled time domain input signal, a frequency transforming unit to transform the core-encoded time domain input signal to a frequency domain input signal, and an extension encoding unit to perform bandwidth extension encoding using characteristics of the frequency domain input signal, and using a basic signal of the frequency domain input signal.

The extension encoding unit may include a basic signal generator to generate the basic signal of the frequency domain input signal, using a frequency spectrum of the frequency domain input signal, a factor estimator to estimate an energy control factor using the basic signal and the characteristics of the frequency domain input signal, an energy extractor to extract an energy from the frequency domain input signal, an energy controller to control the extracted energy using the energy control factor, and an energy quantizer to quantize the controlled energy.

The foregoing and/or other aspects are also achieved by providing an encoding apparatus including an encoding mode selecting unit to select an encoding mode of bandwidth extension encoding using a frequency domain input signal and a time domain input signal, and an extension encoding unit to perform the bandwidth extension encoding using the frequency domain input signal and the selected encoding mode.

The extension encoding unit may include an energy extractor to extract an energy from the frequency domain input signal, based on the encoding mode, an energy controller to control the extracted energy based on the encoding mode, and an energy quantizer to quantize the controlled energy based on the encoding mode.

The foregoing and/or other aspects are achieved by providing a decoding apparatus including a core-decoding unit to core-decode a time domain input signal, the time domain input signal being contained in a bitstream and being core-encoded, an up-sampling unit to up-sample the core-decoded time domain input signal, a frequency transforming unit to transform the up-sampled time domain input signal to a frequency domain input signal, and an extension decoding unit to perform bandwidth extension decoding, using an energy of the time domain input signal and using the frequency domain input signal.

The extension decoding unit may include an inverse-quantizer to inverse-quantize the energy of the time domain input signal, a basic signal generator to generate a basic signal using the frequency domain input signal, a gain calculating unit to calculate a gain using the inverse-quantized energy and an energy of the basic signal, the gain being applied to the basic signal, and a gain applier to apply the calculated gain for each frequency band.

The basic signal generator may include an artificial signal generator to generate an artificial signal corresponding to a high-frequency section by copying and folding a low-frequency section of the frequency domain input signal, an envelope estimator to estimate an envelope of the basic signal using a window contained in the bitstream, and an envelope applier to apply the estimated envelope to the artificial signal.

The foregoing and/or other aspects are achieved by providing an encoding method including down-sampling a time domain input signal, core-encoding the down-sampled time domain input signal, transforming the time domain input signal to a frequency domain input signal, and performing bandwidth extension encoding using a basic signal of the frequency domain input signal.

The foregoing and/or other aspects are also achieved by providing an encoding method including down-sampling a time domain input signal, core-encoding the down-sampled time domain input signal, transforming the core-encoded time domain input signal to a frequency domain input signal, and performing bandwidth extension encoding using characteristics of the frequency domain input signal, and using a basic signal of the frequency domain input signal.

The foregoing and/or other aspects are also achieved by providing an encoding method including selecting an encoding mode of bandwidth extension encoding using a frequency domain input signal and a time domain input signal, and performing the bandwidth extension encoding using the frequency domain input signal and the selected encoding mode.

The foregoing and/or other aspects are achieved by providing a decoding method including core-decoding a time domain input signal, the time domain input signal being contained in a bitstream and being core-encoded, up-sampling the core-decoded time domain input signal, transforming the up-sampled time domain input signal to a frequency domain input signal, and performing bandwidth extension decoding, using an energy of the time domain input signal and using the frequency domain input signal.

Additional aspects, features, and/or advantages of example embodiments will be set forth in part in the description which follows and, in part, will be apparent from the description, or may be learned by practice of the disclosure.

According to example embodiments, a basic signal of an input signal may be extracted, and an energy of the input signal may be controlled using a tonality of a high-frequency domain of the input signal and using a tonality of the basic signal, and thus it is possible to efficiently extend a bandwidth of the high frequency domain.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
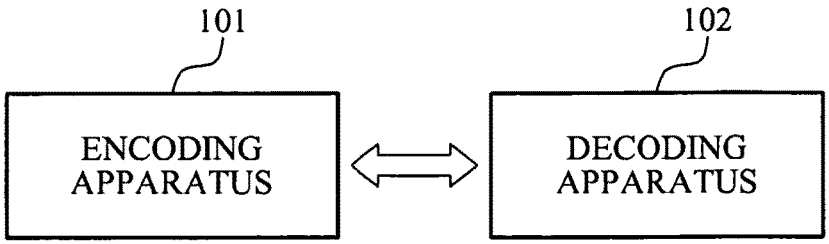
FIG. 1 illustrates a block diagram of an encoding apparatus and a decoding apparatus according to example embodiments.

Reference will now be made in detail to example embodiments, examples of which are illustrated in the accompanying drawings, wherein like reference numerals refer to the like elements throughout. Example embodiments are described below to explain the present disclosure by referring to the figures.

FIG. 1 illustrates a block diagram of an encoding apparatus 101 and a decoding apparatus 102 according to example embodiments.

The encoding apparatus 101 may generate a basic signal of an input signal, and may transmit the generated basic signal to the decoding apparatus 102. Here, the basic signal may be generated based on a low-frequency signal, and may refer to a signal from which envelope information of the low-frequency signal is whitened and accordingly, the basic signal may be an excitation signal. When the basic signal is received, the decoding apparatus 102 may decode the input signal from the basic signal. In other words, the encoding apparatus 101 and the decoding apparatus 102 may perform Super Wide Band Bandwidth Extension (SWB BWE). Specifically, the SWB BWE may be performed to generate a signal in a high-frequency domain from 6.4 kilohertz (KHz) to 16 KHz corresponding to an SWB, based on a decoded Wide Band (WB) signal in a low-frequency domain from 0 KHz to 6.4 KHz. Here, the 16 KHz may vary depending on circumstances. Additionally, the decoded WB signal may be generated through a speech codec based on a Linear Prediction Domain (LPD)-based Code Excited Linear Prediction (CELP), or may be generated by a scheme of performing quantization in a frequency domain. The scheme of performing quantization in a frequency domain may include, for example, an Advanced Audio Coding (AAC) scheme performed based on Modified Discrete Cosine Transform (MDCT).

Hereinafter, operations of the encoding apparatus 101 and the decoding apparatus 102 will be further described.

Figure 2:
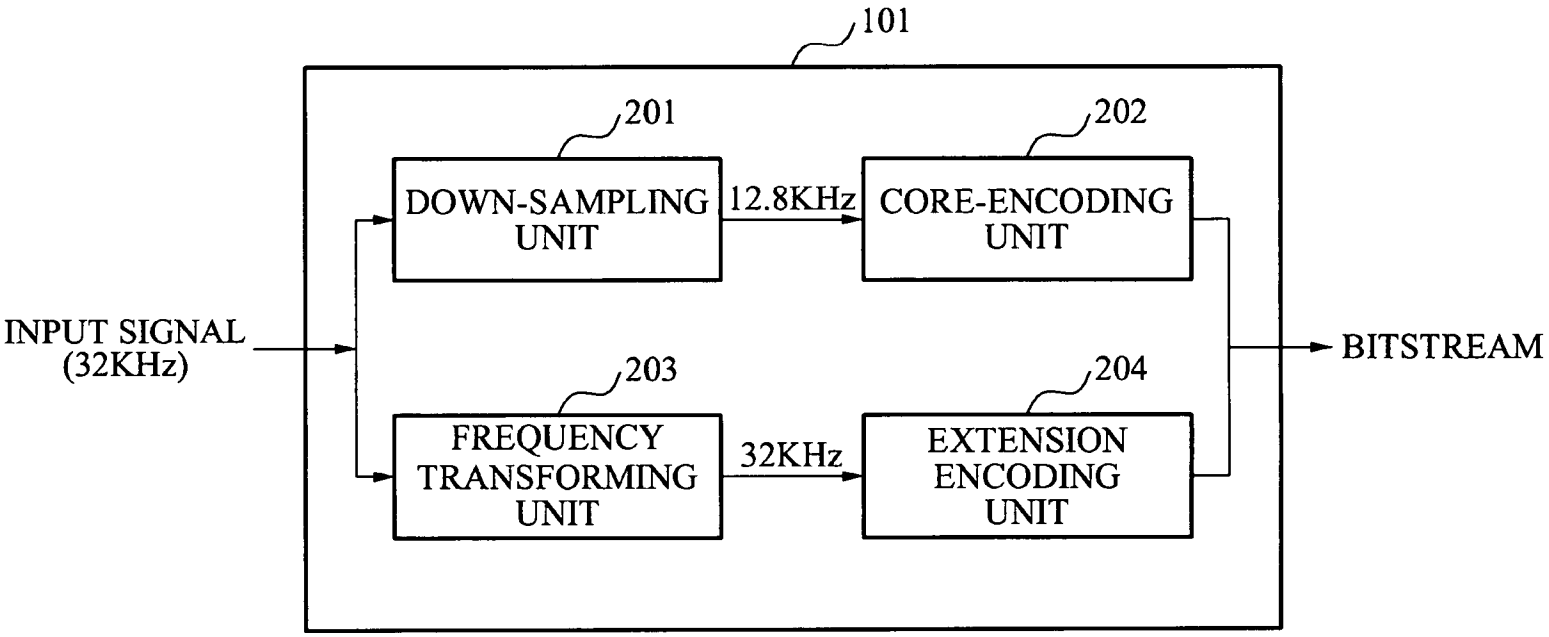
FIG. 2 illustrates a block diagram of an example of the encoding apparatus of FIG. 1.

FIG. 2 illustrates a block diagram of a configuration of the encoding apparatus 101 of FIG. 1.

Referring to FIG. 2, the encoding apparatus 101 may include, for example, a down-sampling unit 201, a core-encoding unit 202, a frequency transforming unit 203, and an extension encoding unit 204.

The down-sampling unit 201 may down-sample a time domain input signal for WB coding. Since the time domain input signal, namely an SWB signal, typically has a 32 KHz sampling rate, there is a need to convert the sampling rate into a sampling rate suitable for WB coding. For example, the down-sampling unit 201 may down-sample the time domain input signal from the 32 KHz sampling rate to a 12.8 KHz sampling rate.

The core-encoding unit 202 may core-encode the down-sampled time domain input signal. In other words, the core-encoding unit 202 may perform WB coding. For example, the core-encoding unit 202 may perform a CELP type WB coding.

The frequency transforming unit 203 may transform the time domain input signal to a frequency domain input signal. For example, the frequency transforming unit 203 may use either a Fast Fourier Transform (FFT) or an MDCT, to transform the time domain input signal to the frequency domain input signal. Hereinafter, it may be assumed that MDCT is applied.

The extension encoding unit 204 may perform bandwidth extension encoding using a basic signal of the frequency domain input signal. Specifically, the extension encoding unit 204 may perform SWB BWE encoding based on the frequency domain input signal.

Figure 4:
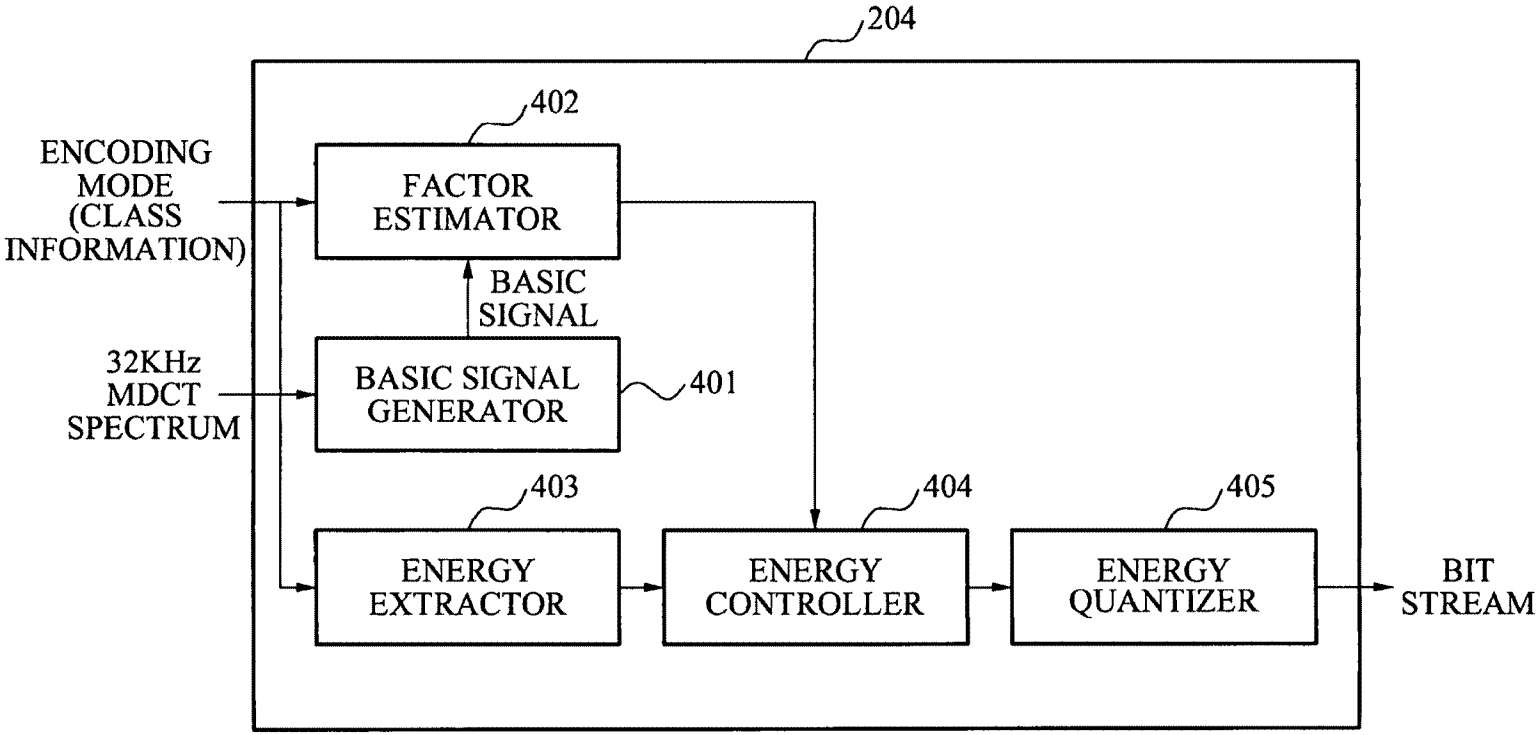
FIG. 4 illustrates a block diagram of an example of an extension encoding unit of the encoding apparatus of FIG. 1.
Figure 5:
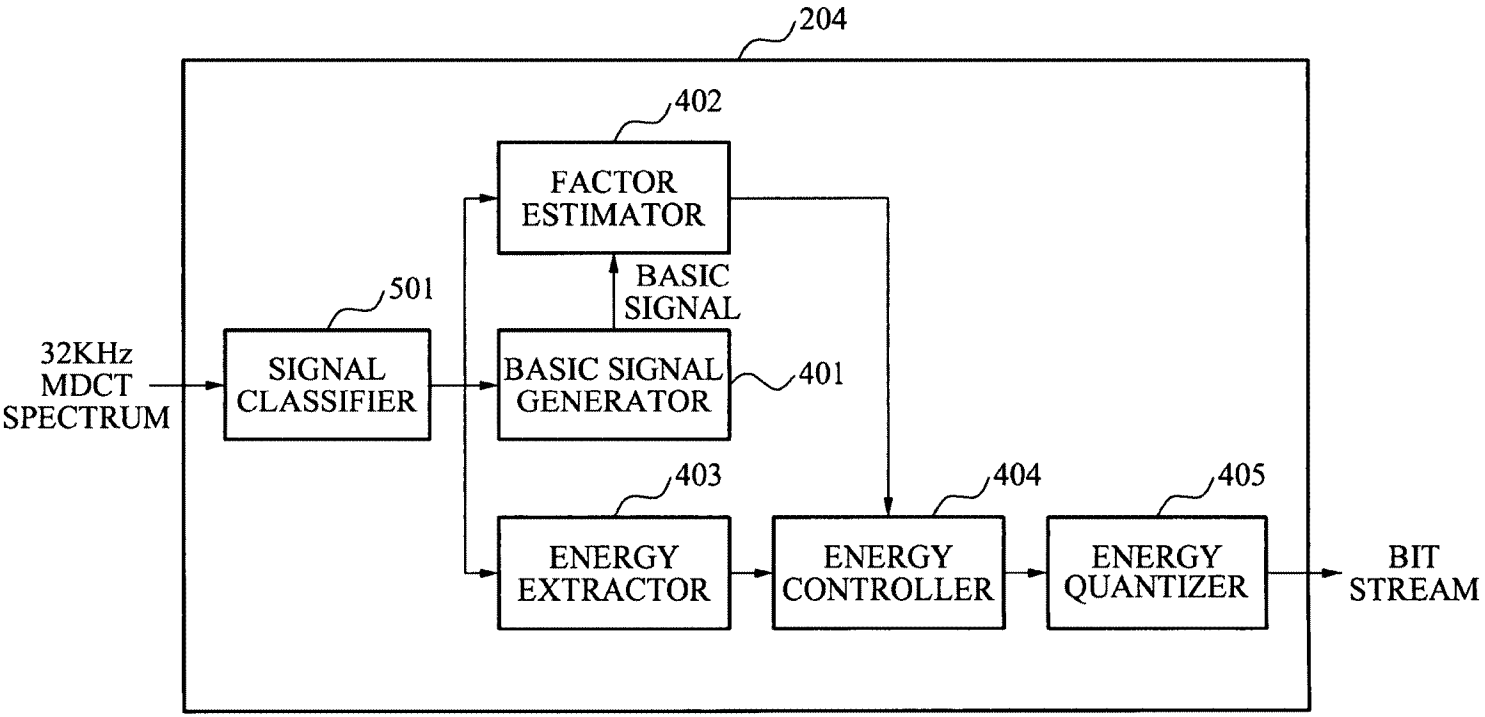
FIG. 5 illustrates a block diagram of another example of the extension encoding unit of the encoding apparatus of FIG. 1.

Additionally, the extension encoding unit 204 may perform bandwidth extension encoding using characteristics of the frequency domain input signal and the basic signal of the frequency domain input signal. Here, the extension encoding unit 204 may be configured as illustrated in FIG. 4 or 5, depending on a source of the characteristics of the frequency domain input signal.

An operation of the extension encoding unit 204 will be further described with reference to FIGS. 4 and 5 below.

In FIG. 2, an upper path indicates the core-encoding, and a lower path indicates the bandwidth extension encoding. In particular, energy information of the input signal may be transferred to the decoding apparatus 102 through the SWB BWE encoding.

Figure 3:
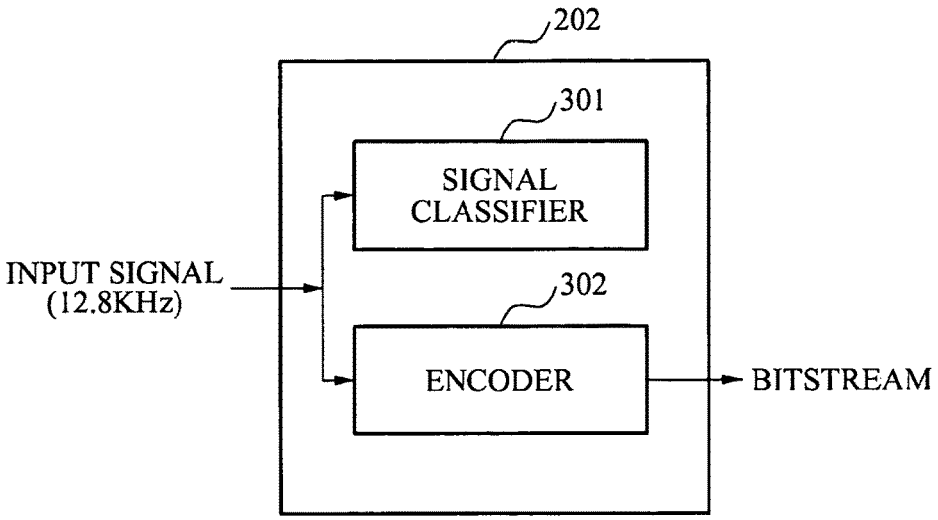
FIG. 3 illustrates a block diagram of a core-encoding unit of the encoding apparatus of FIG. 1.

FIG. 3 illustrates a block diagram of the core-encoding unit 202.

Referring to FIG. 3, the core-encoding unit 202 may include, for example, a signal classifier 301, and an encoder 302.

The signal classifier 301 may classify characteristics of the down-sampled input signal having the 12.8 KHz sampling rate. Specifically, the signal classifier 301 may determine an encoding mode to be applied to the frequency domain input signal, according to the characteristics of the frequency domain input signal. For example, in an International Telecommunications Union-Telecommunications (ITU-T) G.718 codec, the signal classifier 301 may determine a speech signal into one or more of a voiced speech encoding mode, a unvoiced speech encoding mode, a transient encoding mode, and a generic encoding mode. In this example, the unvoiced speech encoding mode may be designed to encode unvoiced speech frames and most of the inactive frames.

The encoder 302 may perform encoding optimized based on the characteristics of the frequency domain input signal classified by the signal classifier 301.

FIG. 4 illustrates a block diagram of an example of the extension encoding unit 204 of FIG. 2.

Referring to FIG. 4, the extension encoding unit 204 may include, for example, a basic signal generator 401, a factor estimator 402, an energy extractor 403, an energy controller 404, and an energy quantizer 405. In an example, the extension encoding unit 204 may estimate an energy control factor, without receiving an input of an encoding mode. In another example, the extension encoding unit 204 may estimate an energy control factor based on an encoding mode that is received from the core-encoding unit 202.

The basic signal generator 401 may generate a basic signal of an input signal using a frequency spectrum of the frequency domain input signal. The basic signal may refer to a signal used to perform SWB BWE based on a WB signal. In other words, the basic signal may refer to a signal used to form a fine structure of a low-frequency domain. An operation of generating a basic signal will be further described with reference to FIG. 6.

In an example, the factor estimator 402 may estimate an energy control factor using the basic signal. Specifically, the encoding apparatus 101 may transmit the energy information of the input signal to the decoding apparatus 102, in order to generate a signal in an SWB domain in the decoding apparatus 102. Additionally, the factor estimator 402 may estimate the energy control factor, to control the energy in a perceptual view. An operation of estimating the energy control factor will be further described with reference to FIG. 7.

In another example, the factor estimator 402 may estimate the energy control factor using the basic signal and the characteristics of the frequency domain input signal. In this example, the characteristics of the frequency domain input signal may be received from the core-encoding unit 202.

The energy extractor 403 may extract energy from the frequency domain input signal. The extracted energy may be transmitted to the decoding apparatus 102. Here, the energy may be extracted for each frequency band.

The energy controller 404 may control the extracted energy using the energy control factor. Specifically, the energy controller 404 may apply the energy control factor to the energy extracted for each frequency band, and may control the energy.

The energy quantizer 405 may quantize the controlled energy. The energy may be converted into a decibel (dB) scale, and may be quantized. Specifically, the energy quantizer 405 may acquire a global energy, namely a total energy, and may perform Scalar Quantization (SQ) on the global energy, and on a difference between the global energy and the energy for each frequency band. Additionally, a first band may directly quantize energy, and a following band may quantize a difference between a current band and a previous band. Furthermore, the energy quantizer 405 may directly quantize the energy for each frequency band, without using a difference value between frequency bands. When the energy is quantized for each frequency band, either SQ or Vector Quantization (VQ) may be used. The energy quantizer 405 will be further described with reference to FIGS. 8 and 9 below.

FIG. 5 illustrates a block diagram of another example of the extension encoding unit 204.

The extension encoding unit 204 of FIG. 5 may further include a signal classifier 501 and accordingly, may be different from the extension encoding unit 204 of FIG. 4. For example, the factor estimator 402 may estimate the energy control factor using the basic signal and the characteristics of the frequency domain input signal. In this example, the characteristics of the frequency domain input signal may be received from the signal classifier 501, instead of the core-encoding unit 202.

The signal classifier 501 may classify the input signal having the 32 KHz sampling rate based on the characteristics of the frequency domain input signal, using an MDCT spectrum. Specifically, the signal classifier 501 may determine an encoding mode to be applied to the frequency domain input signal, according to the characteristics of the frequency domain input signal.

When the characteristics of the input signal are classified, an energy control factor may be extracted from a signal and the energy may be controlled. In an embodiment, an energy control factor may only be extracted from a signal suitable for estimation of an energy control factor. For example, a signal that does not include a tonal component, such as a noise signal or unvoiced speech signal, may not be suitable for the estimation of the energy control factor. Here, when the input signal is classified as the unvoiced speech encoding mode, the extension encoding unit 204 may perform bandwidth extension encoding, rather than estimating the energy control factor.

A basic signal generator 401, a factor estimator 402, an energy extractor 403, an energy controller 404, and an energy quantizer 405 shown in FIG. 5 may perform the same functions as the basic signal generator 401, the factor estimator 402, the energy extractor 403, the energy controller 404, and the energy quantizer 405 shown in FIG. 4, and accordingly further descriptions thereof will be omitted.

Figure 6:
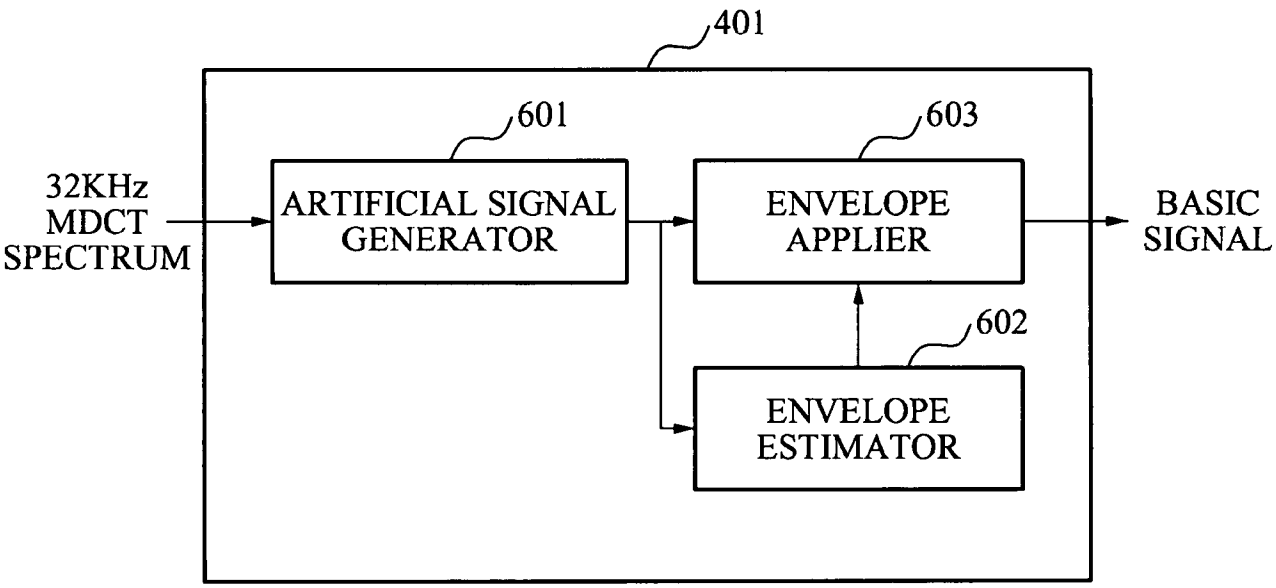
FIG. 6 illustrates a block diagram of a basic signal generator of the extension encoding unit.

FIG. 6 illustrates a block diagram of the basic signal generator 401.

Referring to FIG. 6, the basic signal generator 401 may include, for example, an artificial signal generator 601, an envelope estimator 602, and an envelope applier 603.

The artificial signal generator 601 may generate an artificial signal corresponding to a high-frequency section by copying and folding a low-frequency section of the frequency domain input signal. Specifically, the artificial signal generator 601 may copy a low-frequency spectrum of the frequency domain input signal, and may generate an artificial signal in an SWB domain. An operation of generating an artificial signal will be further described with reference to FIG. 10.

The envelope estimator 602 may estimate an envelope of the basic signal using a window. The envelope of the basic signal may be used to remove envelope information of a low-frequency domain included in a frequency spectrum of the artificial signal in the SWB domain. An envelope of a predetermined frequency index may be determined using a frequency spectrum before and after the predetermined frequency. Additionally, an envelope may be estimated through a moving average. For example, when an MDCT is used to transform a frequency, the envelope of the basic signal may be estimated using an absolute value of an MDCT-transformed frequency spectrum.

Here, the envelope estimator 602 may form whitening bands, and may estimate an average of frequency magnitudes for each of the whitening bands as an envelope of a frequency contained in each of the whitening bands. A number of frequency spectrums contained in the whitening bands may be set to be less than a number of bands for extracting an energy.

When the average of frequency magnitudes for each of the whitening bands is estimated as the envelope of the frequency contained in each of the whitening bands, the envelope estimator 602 may transmit information including the number of frequency spectrums in the whitening bands, and may adjust a smoothness of the basic signal. Specifically, the envelope estimator 602 may transmit the information including the number of frequency spectrums in the whitening bands, based on whether a whitening band includes eight spectrums or three spectrums. For example, when a whitening band includes three spectrums, a further flattened basic signal may be generated, compared to a whitening band including eight spectrums.

Additionally, the envelope estimator 602 may estimate an envelope based on the encoding mode used during encoding by the core-encoding unit 202, rather than transmitting the information including the number of frequency spectrums in the whitening bands. The core-encoding unit 202 may classify the input signal into the voiced speech encoding mode, the unvoiced speech encoding mode, the transient encoding mode, and the generic encoding mode, based on the characteristics of the input signal, and may encode the input signal.

Here, the envelope estimator 602 may control the number of frequency spectrums contained in the whitening bands, based on the encoding modes according to the characteristics of the input signal. In an example, when the input signal is encoded based on the voiced speech encoding mode, the envelope estimator 602 may form a whitening band with three frequency spectrums, and may estimate an envelope. In another example, when the input signal is encoded based on encoding modes other than the voiced speech encoding mode, the envelope estimator 602 may form a whitening band with three frequency spectrums, and may estimate an envelope.

The envelope applier 603 may apply the estimated envelope to the artificial signal. An operation of applying the estimated envelope to the artificial signal is referred to as "whitening", and the artificial signal may be smoothed by the envelope. The envelope applier 603 may divide the artificial signal into envelopes of each frequency index, and may generate a basic signal.

Figure 7:
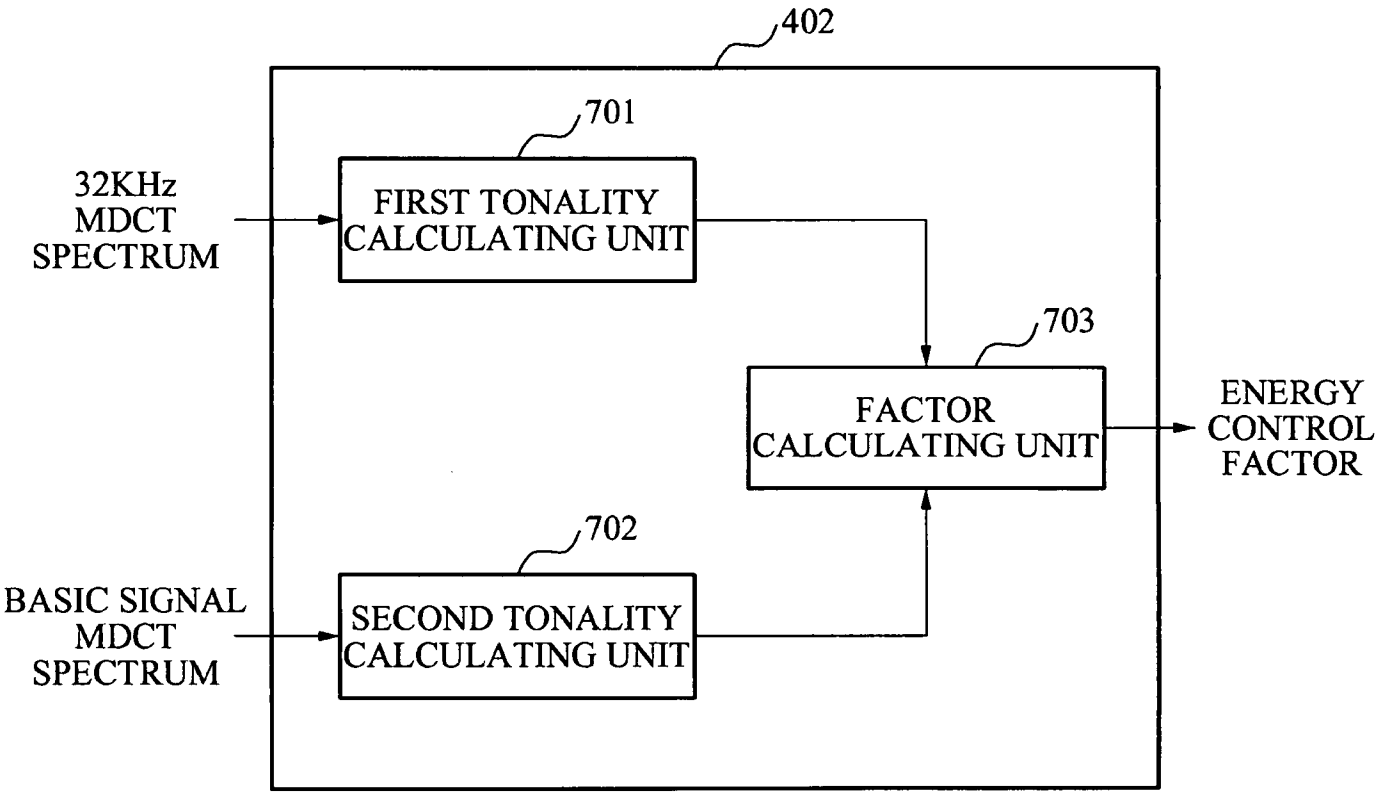
FIG. 7 illustrates a block diagram of a factor estimator of the extension encoding unit.

FIG. 7 illustrates a block diagram of the factor estimator 402.

Referring to FIG. 7, the factor estimator 402 may include, for example, a first tonality calculating unit 701, a second tonality calculating unit 702, and a factor calculating unit 703.

The first tonality calculating unit 701 may calculate a tonality of a high-frequency section of the frequency domain input signal. In other words, the first tonality calculating unit 701 may calculate a tonality of an SWB domain, namely, the high-frequency section of the input signal.

The second tonality calculating unit 702 may calculate a tonality of the basic signal.

A tonality may be calculated by measuring a spectral flatness. Specifically, a tonality may be calculated using Equation 1 as below. The spectral flatness may be measured based on a relationship between a geometric average and an arithmetic average of the frequency spectrum.

$$T = \min\left(10 * \log10\left(\frac{\prod_{k=0}^{N-1} |S(k)|^{\frac{1}{N}}}{\frac{1}{N}\prod_{k=0}^{N-1} |S(k)|}\right) \Big/ r,\ 0.999\right) \quad \text{[Equation 1]}$$

$T$: tonality, $S(k)$: spectrum, $N$: length of spectral coefficients, $r$: constant The factor calculating unit 703 may calculate the energy control factor using the tonality of the high-frequency domain and the tonality of the basic signal. Here, the energy control factor may be calculated using the following Equation 2:

$$\alpha = \frac{N_o}{N_b} = \frac{(1 - T_o)}{(1 - T_b)}, \quad \text{[Equation 2]}$$

$T_o$: tonality of original spectrum, $T_b$: tonality of base spectrum, $N_o$: noisiness factor of original spectrum, $N_b$: noisiness factor of base spectrum In Equation 2, a denotes an energy control factor, T, denotes a tonality of an input signal, and Tb denotes a tonality of a basic signal. Additionally, Nb denotes a noisiness factor indicating how many noise components are contained in a signal.

The energy control factor may also be calculated using the following Equation 3:

$$\alpha = \frac{T_b}{T_o} \quad \text{[Equation 3]}$$

The factor calculating unit 703 may calculate the energy control factor for each frequency band. The calculated energy control factor may be applied to the energy of the input signal. Specifically, when the energy control factor is less than a predetermined energy control factor, the energy control factor may be applied to the energy of the input signal.

Figure 8:
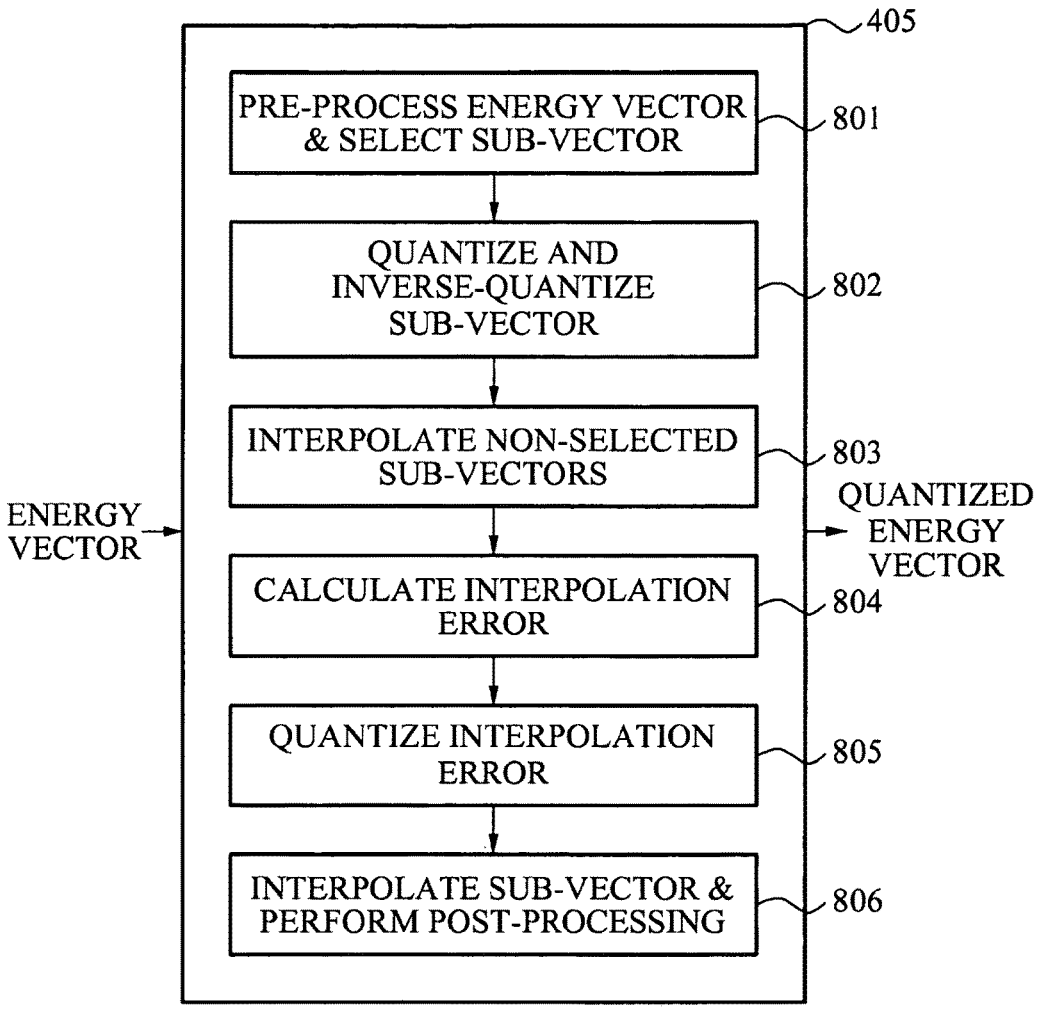
FIG. 8 illustrates a flowchart of an operation of an energy quantizer of the encoding apparatus of FIG. 1.

FIG. 8 illustrates a flowchart of an operation of the energy quantizer 405.

In operation 801, the energy quantizer 405 may pre-process an energy vector using the energy control factor, and may select a sub-vector of the pre-processed energy vector. For example, the energy quantizer 405 may subtract an average value from an energy value of each of selected energy vectors, or may calculate a weight for importance of each energy vector. Here, the weight for the importance may be calculated so that a quality of a complex sound may be maximized.

Additionally, the energy quantizer 405 may appropriately select a sub-vector of the energy vector, based on an encoding efficiency. To improve an interpolation effect, the energy quantizer 405 may select the sub-vector at regular intervals.

For example, the energy quantizer 405 may select a sub-vector based on the following Equation 4:

$$k*n(n=0, \ldots, \text{and } N),\ k>=2,\ N \text{ is an integer less than a vector dimension.} \quad \text{[Equation 4]}$$

In Equation 4, when k has a value of "2", only an even number may be selected as N.

In operation 802, the energy quantizer 405 may quantize and inverse-quantize the selected sub-vector. The energy quantizer 405 may select a quantization index for minimizing a Mean Square Error (MSE), and may quantize the selected sub-vector. Here, the MSE may be calculated using the following Equation 5:

$$MSE:\ d[x, y] = \frac{1}{N}\sum_{k=1}^{N} [x_k - y_k]^2 \quad \text{[Equation 5]}$$

The energy quantizer 405 may quantize the sub-vector, based on one of SQ, VQ, Trellis Coded Quantization (TCQ), and Lattice Vector Quantization (LVQ). Here, the VQ may be performed based on either multi-stage VQ or split VQ, or may be performed using both the multi-stage VQ and split VQ. The quantization index may be transmitted to the decoding apparatus 102.

When the weight for the importance is calculated in operation 801, the energy quantizer 405 may obtain an optimized quantization index using a Weighted Mean Square Error (WMSE). Here, the WMSE may be calculated using the following Equation 6:

$$WMSE:\ d[x, y] = \frac{1}{N}\sum_{k=1}^{N} w_k [x_k - y_k]^2 \quad \text{[Equation 6]}$$

In operation 803, the energy quantizer 405 may interpolate non-selected sub-vectors using the inverse-quantized sub-vector.

In operation 804, the energy quantizer 405 may calculate an interpolation error, namely, a difference between the interpolated non-selected sub-vectors and sub-vectors matched to the original energy vector.

In operation 805, the energy quantizer 405 may quantize the interpolation error. Here, the energy quantizer 405 may quantize the interpolation error using the quantization index for minimizing the MSE. The energy quantizer 405 may quantize the interpolation error based on one of the SQ, the VQ, the TCQ, and the LVQ. The VQ may be performed based on either multi-stage VQ or split VQ, or may be performed using both the multi-stage VQ and split VQ. When the weight for the importance is calculated in operation 801, the energy quantizer 405 may obtain an optimized quantization index using the WMSE.

In operation 806, the energy quantizer 405 may interpolate sub-vectors that are selected and quantized, may calculate the non-selected sub-vectors, and may add the interpolation error quantized in operation 805, to calculate a final quantized energy. Additionally, the energy quantizer 405 may perform post-processing to add the average value to the energy value, so that the final quantized energy may be obtained.

The energy quantizer 405 may perform multi-stage VQ using K candidates for the sub-vector, in order to improve a quantization performance using the same code book. For example, when at least two candidates for the sub-vector exist, the energy quantizer 405 may perform a distortion measure, and may determine an optimal candidate for the sub-vector. Here, the distortion measure may be determined based on two schemes.

In a first scheme, the energy quantizer 405 may generate an index set for minimizing an MSE or WMSE in each stage for each candidate, and may select candidates for a sub-vector having a smallest sum of an MSE or WMSE in all stages. Here, the first scheme may have an advantage of a simple calculation.

In a second scheme, the energy quantizer 405 may generate an index set for minimizing an MSE or WMSE in each stage for each candidate, may restore the energy vector through an inverse-quantization operation, and may select candidates for a sub-vector for minimizing an MSE or WMSE between the restored energy vector and an original energy vector. Here, the MSE may be obtained using an actual quantized value, even when a calculation amount for restoration is added. Thus, the second scheme may have an advantage of an excellent performance.

Figure 9:
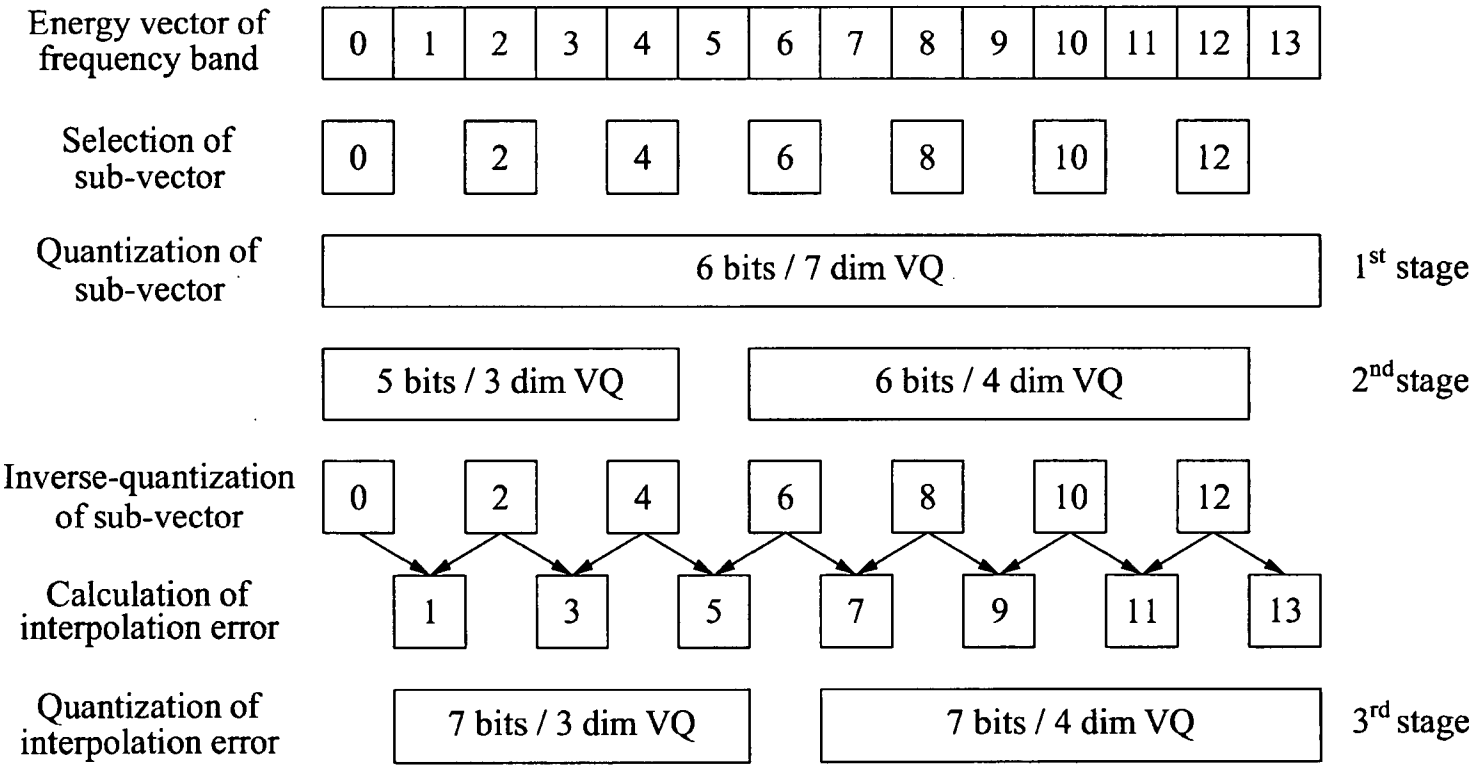
FIG. 9 illustrates a diagram of an operation of quantizing an energy according to example embodiments.

FIG. 9 illustrates an operation of quantizing an energy according to examp▸e embodiments.

Referring to FIG. 9, an energy vector may represent 14 dimensions. In a first stage of FIG. 9, the energy quantizer 405 may select only even numbers from the energy vector, and may select a sub-vector corresponding to 7 dimensions. In a second stage, the energy quantizer 405 may perform VQ that is split into two quantization stages.

In the second stage, the energy quantizer 405 may perform quantization using an error signal of the first stage. The energy quantizer 405 may obtain an interpolation error through an operation of inverse-quantizing the selected sub-vector. In a third stage, the energy quantizer 405 may quantize the interpolation error through two split VQ.

Figure 10:
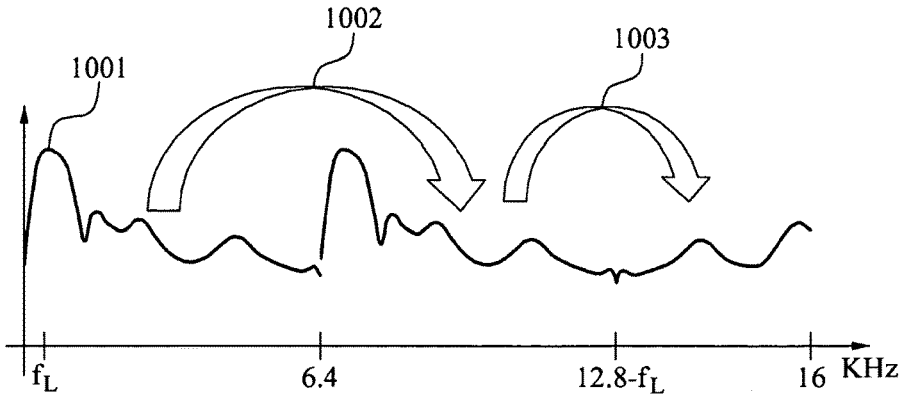
FIG. 10 illustrates a diagram of an operation of generating an artificial signal according to example embodiments.

FIG. 10 illustrates a diagram of an operation of generating an artificial signal according to example embodiments.

Referring to FIG. 10, the artificial signal generator 601 may copy a frequency spectrum 1001 corresponding to a low-frequency domain from $f_L$ KHz to 6.4 KHz in a total frequency band. The copied frequency spectrum 1001 may be shifted to a frequency domain from 6.4 KHz to 12.8-$f_L$ KHz. Additionally, a frequency spectrum corresponding to a frequency domain from 12.8-$f_L$ KHz to 16 KHz may be generated by folding a frequency spectrum corresponding to the frequency domain from 6.4 KHz to 12.8-$f_L$ KHz. In other words, an artificial signal corresponding to an SWB domain, namely a high-frequency domain, may be generated in a frequency domain from 6.4 KHz to 16 KHz.

Here, when an MDCT is used to generate a frequency spectrum, a relationship between $f_L$ KHz and 6.4 KHz may exist. Specifically, when a frequency index of the MDCT corresponding to 6.4 KHz is an even number, a frequency index for $f_L$ KHz may need to be an even number. Conversely, when the frequency index of the MDCT corresponding to 6.4 KHz is an odd number, the frequency index for $f_L$ KHz may need to be an odd number.

For example, when an MDCT is applied to extract 640 spectrums for the original input signal, a 256-th frequency index may correspond to 6.4 KHz, and the frequency index of the MDCT corresponding to 6.4 KHz may be an even number (6400/16000*640). In this example, $f_L$ needs to be selected as an even number. In other words, 2 (50 Hz), 4 (100 Hz) and the like may be used as $f_i$. The operation of FIG. 10 may be equally applied to a decoding operation.

Figure 11A:
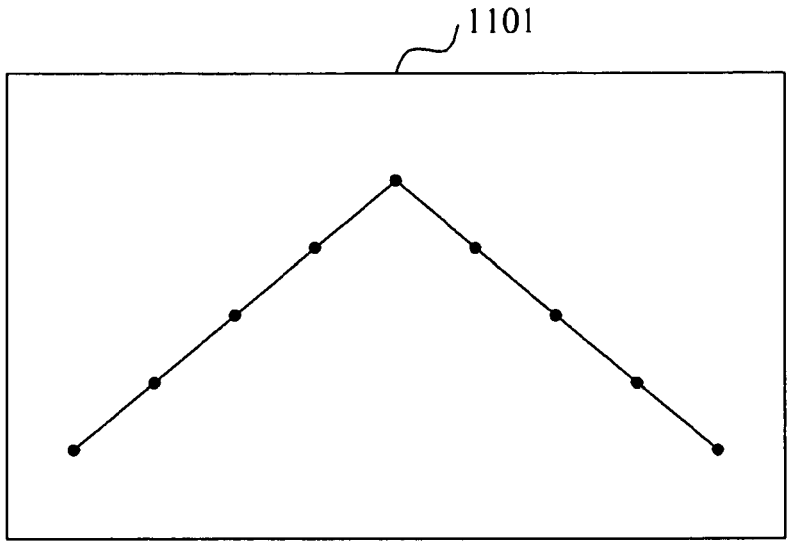
FIGS. 11A and 11B illustrate diagrams of examples of a window for estimating an envelope according to example embodiments.
Figure 11B:
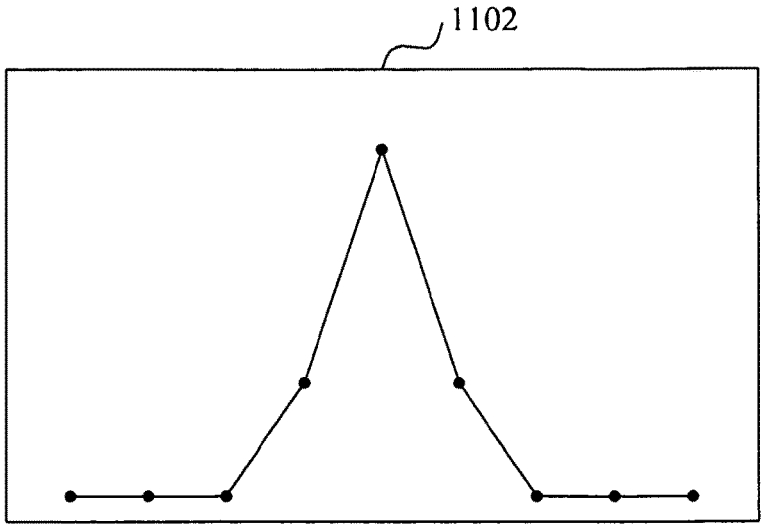

FIGS. 11A and 11B illustrate diagrams of examples of a window for estimating an envelope according to example embodiments.

Referring to FIGS. 11A and 11B, a peak of a window 1101 and a peak of a window 1102 may each indicate a frequency index where a current envelope is to be estimated. The envelope of the basic signal may be estimated using the following Equation 7:

$$\mathrm{Env}(n) = \sum_{k=n-d}^{n+d} w(k-n+d) * |S(k)| \qquad \text{[Equation 7]}$$

Env($n$): Envelope, $w(k)$: window, $S(k)$: Spectrum, $n$: frequency index, $2d+1$: window length The windows 1101 and 1102 may be used to be fixed at all times, and there is no need to additionally transmit a bit. When the windows 1101 and 1102 are selectively used, information indicating which window is used to estimate an envelope may be represented by bits, and may be additionally transferred to the decoding apparatus 102. The bits may be transmitted for each frequency band, or may be transmitted to a single frame all at once.

Comparing the windows 1101 and 1102, the window 1102 may be used to estimate an envelope by further applying a weight to a frequency spectrum corresponding to a current frequency index, compared with the window 1101. Accordingly, a basic signal generated by the window 1102 may be smoother than a basic signal generated by the window 1101. A type of window may be selected by comparing a frequency spectrum of an input signal with a frequency spectrum of a basic signal generated by the window 1101 or window 1102. Additionally, a window enabling similar tonality through comparison of a tonality of a high-frequency section may be selected. Moreover, a window having a high correlation may be selected by comparing a correlation of high-frequency sections.

Figure 12:
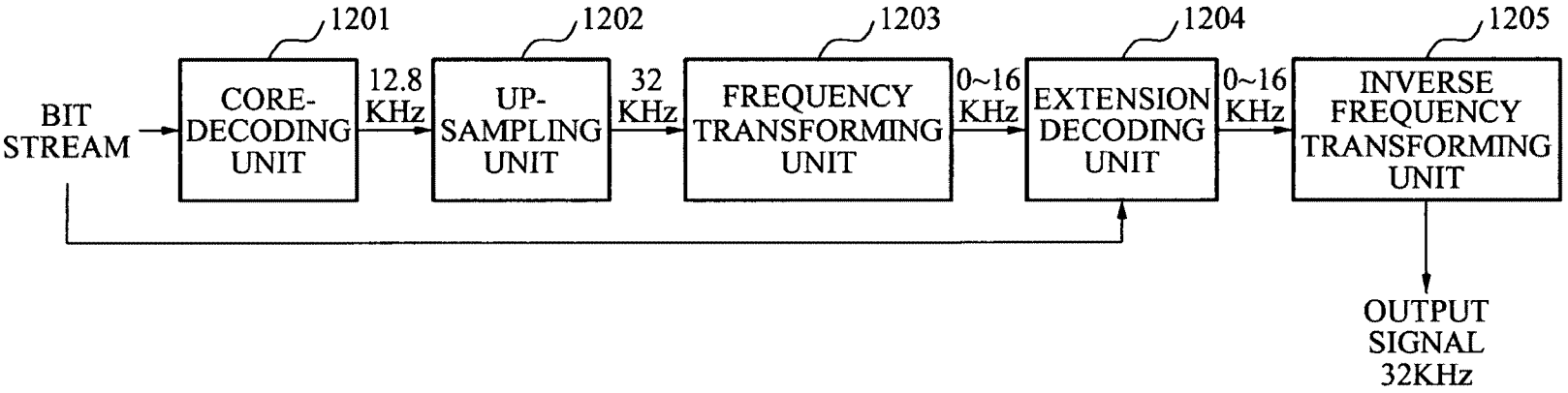
FIG. 12 illustrates a block diagram of the decoding apparatus of FIG. 1.

FIG. 12 illustrates a block diagram of the decoding apparatus 102 of FIG. 1.

The decoding apparatus 102 of FIG. 12 may perform an operation inverse to the encoding apparatus 101 of FIG. 2.

Referring to FIG. 12, the decoding apparatus 102 may include, for example, a core-decoding unit 1201, an up-sampling unit 1202, a frequency transforming unit 1203, an extension decoding unit 1204, and an inverse frequency transforming unit 1205.

The core-decoding unit 1201 may core-decode a time domain input signal that is included in a bitstream and that is core-encoded. A signal with a 12.8 KHz sampling rate may be extracted through the core-decoding.

The up-sampling unit 1202 may up-sample the core-decoded time domain input signal. A signal with a 32 KHz sampling rate may be extracted through the up-sampling.

The frequency transforming unit 1203 may transform the up-sampled time domain input signal to a frequency domain input signal. The up-sampled time domain input signal may be transformed using the same scheme as the frequency transformation scheme used by the encoding apparatus 101, for example, an MDCT scheme may be used.

The extension decoding unit 1204 may perform bandwidth extension decoding using an energy of the time domain input signal and using the frequency domain input signal. An operation of the extension decoding unit 1204 will be further described with reference to FIG. 13.

The inverse frequency transforming unit 1205 may perform inverse frequency transformation with respect to a result of the bandwidth extension decoding. Here, the inverse frequency transformation may be performed in a manner inverse to the frequency transformation scheme used by the frequency transforming unit 1203. For example, the inverse frequency transforming unit 1205 may perform an Inverse Modified Discrete Cosine Transform (IMDCT).

Figure 13:
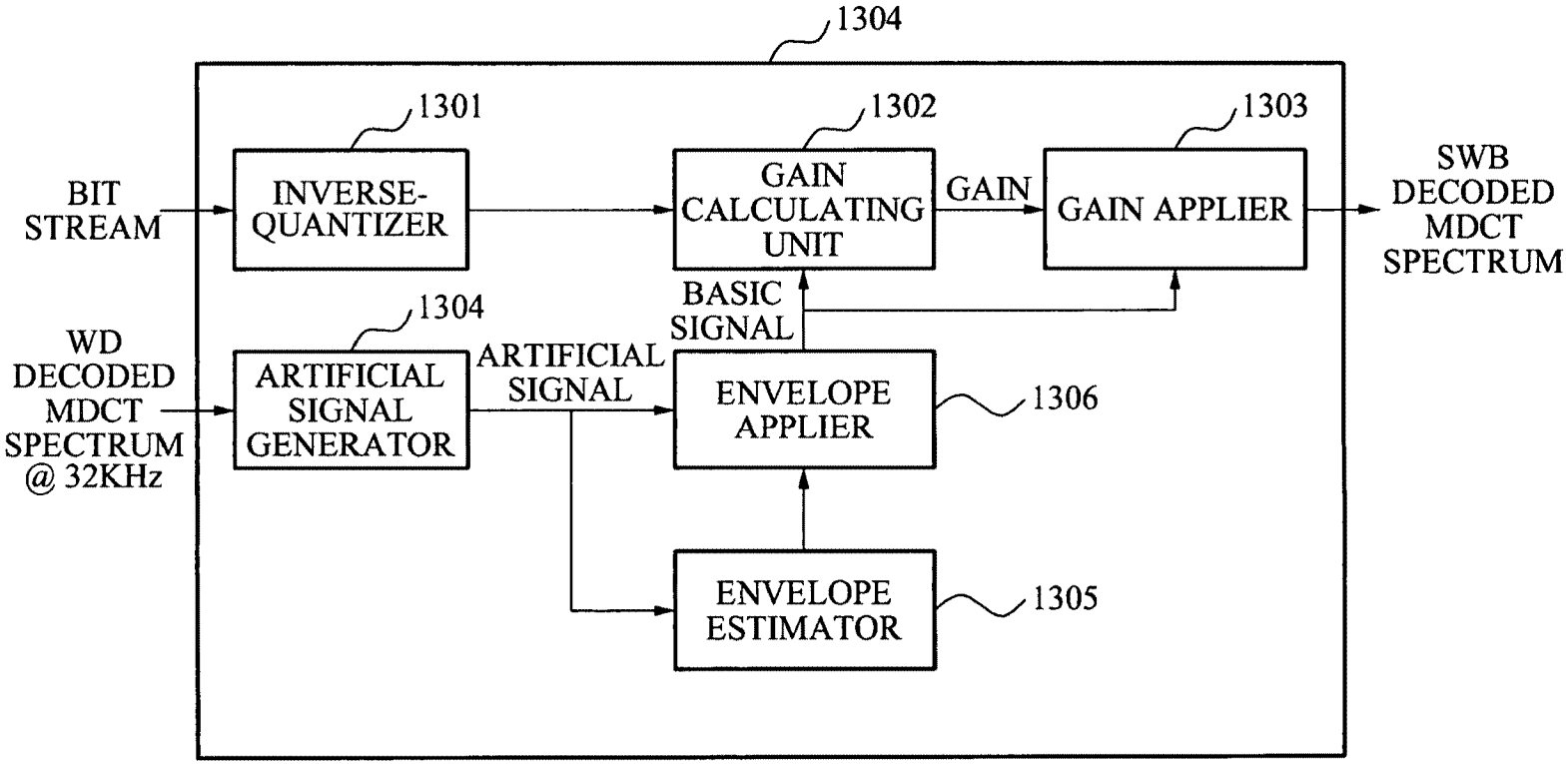
FIG. 13 illustrates a block diagram of an extension decoding unit of FIG. 12.

FIG. 13 illustrates a block diagram of the extension decoding unit 1204 of FIG. 12.

Referring to FIG. 13, the extension decoding unit 1204 may include, for example, an inverse-quantizer 1301, a gain calculating unit 1302, a gain applier 1303, an artificial signal generator 1304, an envelope estimator 1305, and an envelope applier 1306.

The inverse-quantizer 1301 may inverse-quantize the energy of the time domain input signal. An operation of inverse-quantizing the energy will be further described with reference to FIG. 14.

The gain calculating unit 1302 may calculate a gain to be applied to the basic signal, using the inverse-quantized energy and an energy of the basic signal. Specifically, the gain may be determined based on a ratio of the inverse-quantized energy and the energy of the basic signal. Since an energy is typically determined based on a sum of squares of an amplitude of each frequency spectrum, a root value of an energy ratio may be used.

The gain applier 1303 may apply the calculated gain for each frequency band. Accordingly, a frequency spectrum of an SWB may be finally determined.

In an example, the calculating and applying of the gain may be performed by matching a band to a band used to transmit energy, as described above. In another example, to prevent a rapid change in energy, the gain may be calculated and applied by dividing an overall frequency band into sub-bands. In this example, an inverse-quantized energy of a neighboring band may be interpolated, and an energy in a band boundary may be smoothed. For example, each band may be divided into three sub-bands, and an inverse-quantized energy of a current band may be allocated to an intermediate sub-band among the three sub-bands. Subsequently, gains of a first sub-band and a third sub-band may be calculated using a newly smoothed energy, based on an energy allocated to an intermediate band between a previous band and a next band, and based on interpolation. In other words, the gain may be calculated for each band.

Such an energy smoothing scheme may be applied to be fixed at all times. Additionally, the extension encoding unit 204 may transmit information indicating that the energy smoothing scheme is required, and may apply the energy smoothing scheme to only frames requiring the energy smoothing scheme. Here, when smoothing is performed and when less quantization error of a total energy occurs, information indicating a frame requiring the energy smoothing scheme may be selected, compared to when the smoothing is not performed.

A basic signal may be generated using the frequency domain input signal. An operation of generating a basic signal may be performed using components as described below.

The artificial signal generator 1304 may generate an artificial signal corresponding to a high-frequency section by copying and folding a low-frequency section of the frequency domain input signal. Here, the frequency domain input signal may be a WB-decoded signal with a 32 KHz sampling rate.

The envelope estimator 1305 may estimate an envelope of the basic signal using a window contained in the bitstream. The window may be used to estimate the envelope by the encoding apparatus 101. A type of window may be bit type, and the window may be contained in a bitstream and may be transmitted to the decoding apparatus 102.

The envelope applier 1306 may apply the estimated envelope to the artificial signal, and may generate a basic signal.

For example, when the average of frequency magnitudes for each of the whitening bands is estimated as the envelope of the frequency contained in each of the whitening bands, the envelope estimator 602 of the encoding apparatus 101 may transmit, to the decoding apparatus 102, the information including the number of frequency spectrums in the whitening bands. When the information is received, the envelope estimator 1305 of the decoding apparatus 102 may estimate an envelope based on the received information, and the envelope applier 1306 may apply the estimated envelope. Additionally, the envelope estimator 1305 may estimate an envelope based on a core-decoding mode used by the core-decoding unit 1201, rather than transmitting the information including the number of frequency spectrums in the whitening bands.

The core-decoding unit 1201 may determine a decoding mode among a voiced speech decoding mode, an unvoiced speech decoding mode, a transient decoding mode, and a generic decoding mode, based on characteristics of a frequency domain input signal, and may perform decoding in the determined decoding mode. Here, the envelope estimator 1305 may control the number of frequency spectrums in the whitening bands, using the decoding mode based on the characteristics of the frequency domain input signal. In an example, when the frequency domain input signal is decoded in the voiced speech decoding mode, the envelope estimator 1305 may form a whitening band with three frequency spectrums, and may estimate an envelope. In another example, when the frequency domain input signal is decoded in decoding modes other than the voiced speech decoding mode, the envelope estimator 1305 may form a whitening band with three frequency spectrums, and may estimate an envelope.

Figure 14:
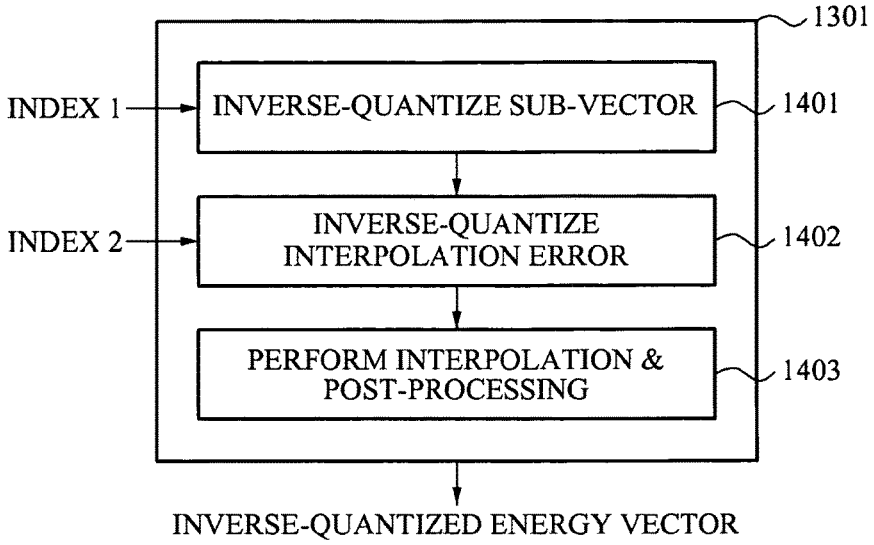
FIG. 14 illustrates a flowchart of an operation of an inverse-quantizer of the extension decoding unit.

FIG. 14 illustrates a flowchart of an operation of the inverse-quantizer 1301.

In operation 1401, the inverse-quantizer 1301 may inverse-quantize the selected sub-vector of the energy vector, using an index 1 received from the encoding apparatus 101.

In operation 1402, the inverse-quantizer 1301 may inverse-quantize an interpolation error corresponding to non-selected sub-vectors, using an index 2 received from the encoding apparatus 101.

In operation 1403, the inverse-quantizer 1301 may interpolate the inverse-quantized sub-vector, and may calculate the non-selected sub-vectors. Additionally, the inverse-quantizer 1301 may add the inverse-quantized interpolation error to the non-selected sub-vectors. Furthermore, the inverse-quantizer 1301 may perform post-processing to add an average value that is subtracted in a pre-processing operation, and may calculate a final inverse-quantized energy.

Figure 15:
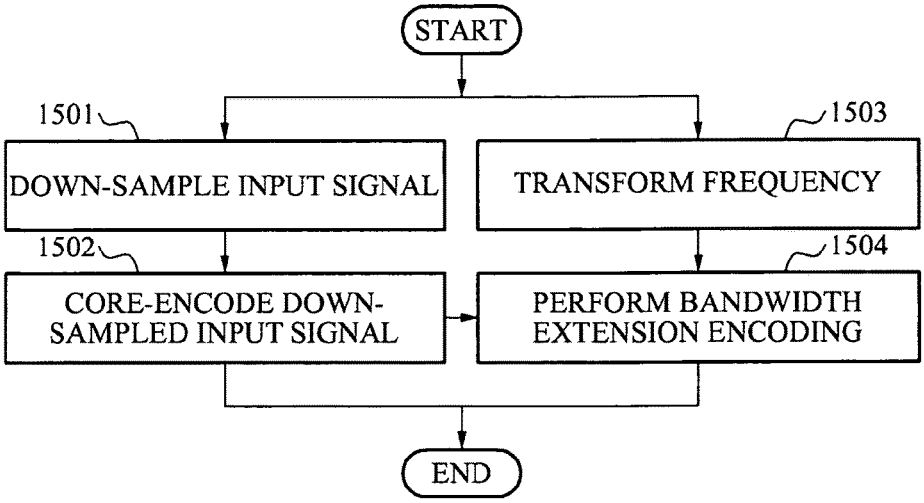
FIG. 15 illustrates a flowchart of an encoding method according to example embodiments.

FIG. 15 illustrates a flowchart of an encoding method according to example embodiments.

In operation 1501, the encoding apparatus 101 may down-sample a time domain input signal.

In operation 1502, the encoding apparatus 101 may core-encode the down-sampled time domain input signal.

In operation 1503, the encoding apparatus 101 may transform the time domain input signal to a frequency domain input signal.

In operation 1504, the encoding apparatus 101 may perform bandwidth extension encoding on the frequency domain input signal. For example, the encoding apparatus 101 may perform the bandwidth extension encoding based on encoding information determined in operation 1502. Here, the encoding information may include an encoding mode classified based on characteristics of the frequency domain input signal.

For example, the encoding apparatus 101 may perform the bandwidth extension encoding by the following operations.

The encoding apparatus 101 may generate a basic signal of the frequency domain input signal, using a frequency spectrum of the frequency domain input signal. Also, the encoding apparatus 101 may generate a basic signal of the frequency domain input signal, using characteristics of the frequency domain input signal and a frequency spectrum of the frequency domain input signal. Here, the characteristics of the frequency domain input signal may be derived through core-encoding, or a separate signal classification. Additionally, the encoding apparatus 101 may estimate an energy control factor using the basic signal. Subsequently, the encoding apparatus 101 may extract an energy from the frequency domain input signal. The encoding apparatus 101 may control the extracted energy using the energy control factor. The encoding apparatus 101 may quantize the controlled energy.

Here, the basic signal may be generated through the following schemes:

The encoding apparatus 101 may generate an artificial signal corresponding to a high-frequency section by copying and folding a low-frequency section of the frequency domain input signal. Additionally, the encoding apparatus 101 may estimate an envelope of the basic signal using a window. Here, the encoding apparatus 101 may select a window based on a comparison result of either a tonality or a correlation, and may estimate the envelope of the basic signal. For example, the encoding apparatus 101 may estimate an average of frequency magnitudes in each of whitening bands, as an envelope of a frequency contained in each of the whitening bands. Specifically, the encoding apparatus 101 may control a number of frequency spectrums in each of the whitening bands, based on a core-encoding mode, and may estimate the envelope of the basic signal.

Subsequently, the encoding apparatus 101 may apply the estimated envelope to the artificial signal, so that the basic signal may be generated.

The energy control factor may be estimated using the following scheme:

The encoding apparatus 101 may calculate a tonality of a high-frequency section of the frequency domain input signal. Additionally, the encoding apparatus 101 may calculate a tonality of the basic signal. Subsequently, the encoding apparatus 101 may calculate the energy control factor using the tonality of the high-frequency section and the tonality of the basic signal.

Additionally, the energy may be quantized through the following scheme:

The encoding apparatus 101 may select a sub-vector of an energy vector, may quantize the selected sub-vector, and may quantize non-selected sub-vectors using an interpolation error. Here, the encoding apparatus 101 may select a sub-vector at regular intervals.

For example, the encoding apparatus 100 may select candidates for the sub-vector, and may perform multi-stage VQ including at least two stages. In this example, the encoding apparatus 100 may generate an index set for minimizing an MSE or WMSE in each stage for each of the candidates for the sub-vector, and may select candidates for a sub-vector having a smallest sum of an MSE or WMSE in all stages. Alternatively, the encoding apparatus 100 may generate an index set for minimizing an MSE or a WMSE in each stage for each of the candidates for the sub-vector, may restore the energy vector through an inverse-quantization operation, and may select candidates for a sub-vector for minimizing an MSE or WMSE between the restored energy vector and an original energy vector.

Figure 16:
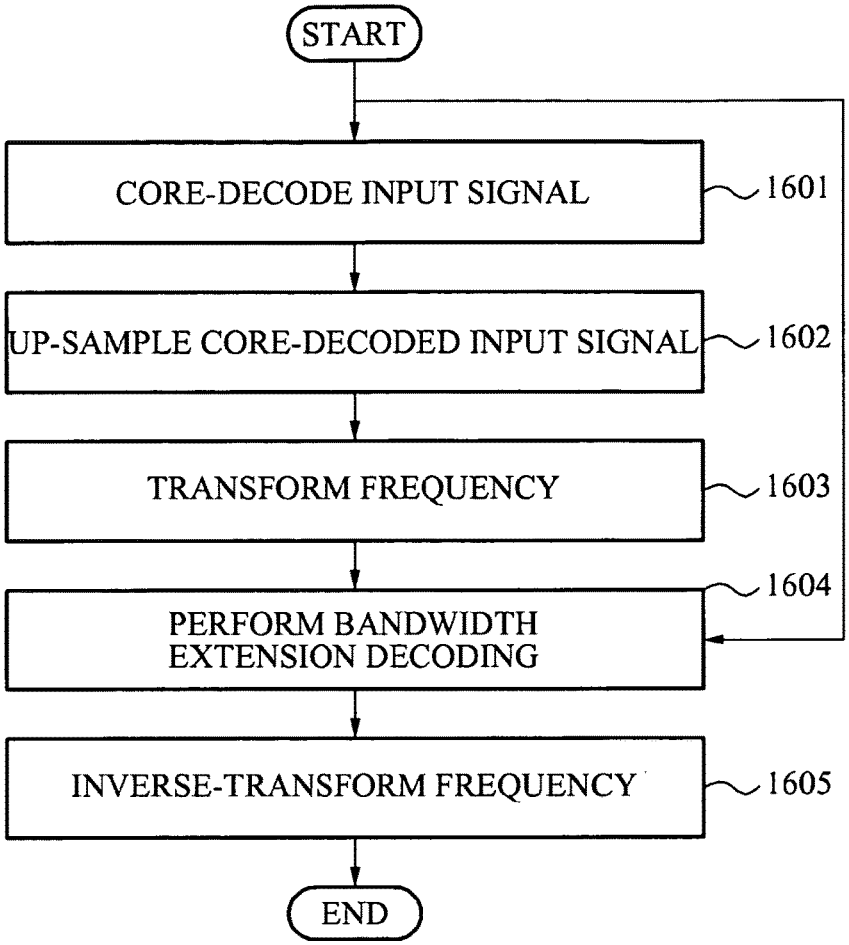
FIG. 16 illustrates a flowchart of a decoding method according to example embodiments.

FIG. 16 illustrates a flowchart of a decoding method according to example embodiments.

In operation 1601, the decoding apparatus 102 may core-decode a time domain input signal that is included in a bitstream and that is core-encoded.

In operation 1602, the decoding apparatus 102 may up-sample the core-decoded time domain input signal.

In operation 1603, the decoding apparatus 102 may transform the up-sampled time domain input signal to a frequency domain input signal.

In operation 1604, the decoding apparatus 102 may perform bandwidth extension decoding using an energy of the time domain input signal and using the frequency domain input signal.

Specifically, the bandwidth extension decoding may be performed as below.

The decoding apparatus 102 may inverse-quantize the energy of the time domain input signal. Here, the decoding apparatus 102 may select a sub-vector of an energy vector, may inverse-quantize the selected sub-vector, may interpolate the inverse-quantized sub-vector, and may add an interpolation error to the interpolated sub-vector, to finally inverse-quantize the energy.

Additionally, the decoding apparatus 102 may generate a basic signal using the frequency domain input signal. Subsequently, the decoding apparatus 102 may calculate a gain to be applied to the basic signal, using the inverse-quantized energy and an energy of the basic signal. Finally, the decoding apparatus 102 may apply the calculated gain for each frequency band.

Specifically, the basic signal may be generated as below.

The decoding apparatus 102 may generate an artificial signal corresponding to a high-frequency section by copying and folding a low-frequency section of the frequency domain input signal. Additionally, the decoding apparatus 102 may estimate an envelope of the basic signal using a window contained in the bitstream. Here, when window information is set to be equally used, the window may not be contained in the bitstream. Subsequently, the decoding apparatus 102 may app▸y the estimated envelope to the artificial signal.

Other descriptions of FIGS. 15 and 16 have been already given above with reference to FIGS. 1 through 14.

Figure 17:
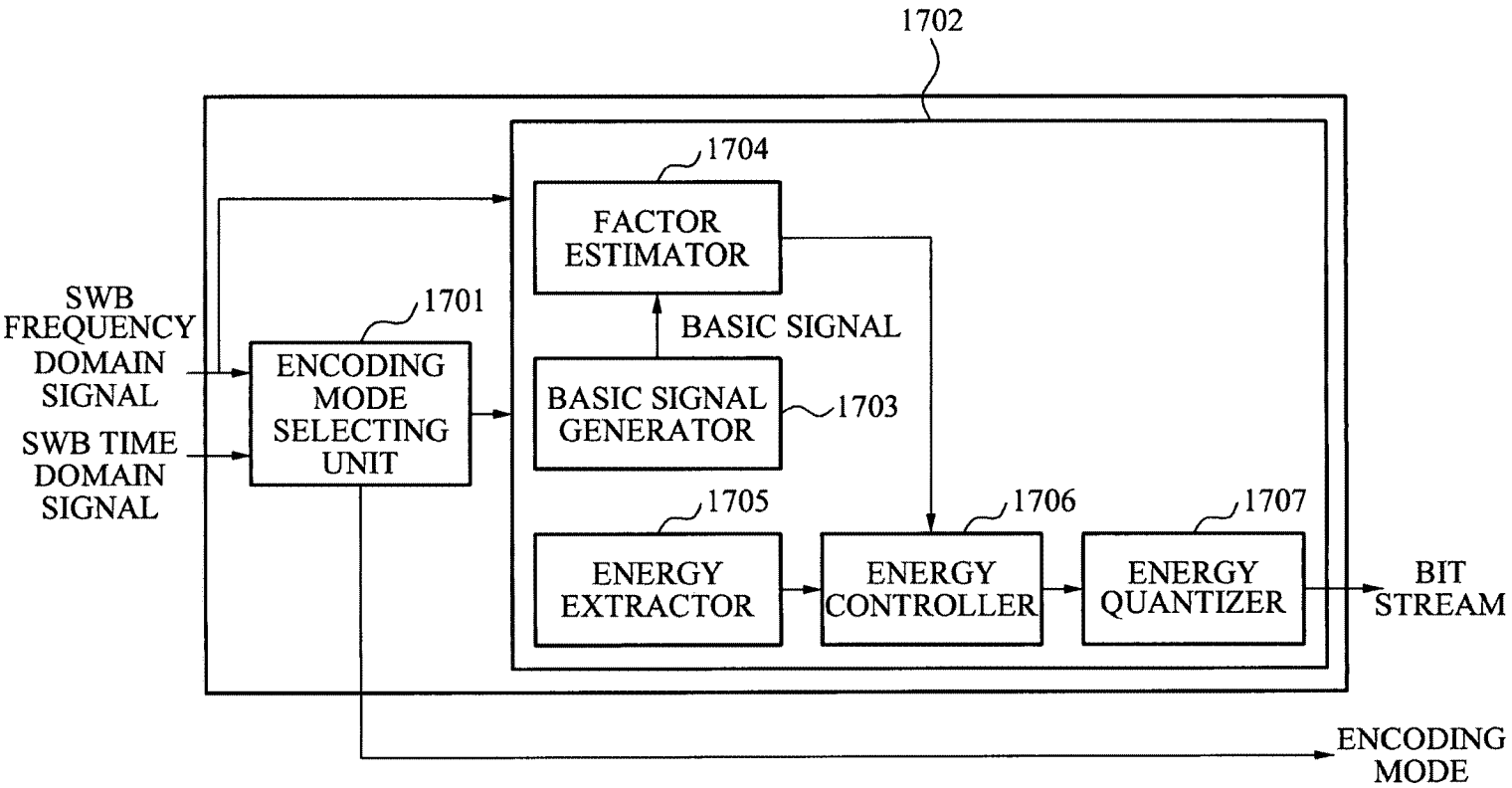
FIG. 17 illustrates a block diagram of another example of the encoding apparatus of FIG. 1.

FIG. 17 illustrates a block diagram of another example of the encoding apparatus 100 according to example embodiments.

Referring to FIG. 17, the encoding apparatus 100 may include, for example, an encoding mode selecting unit 1701, and an extension encoding unit 1702.

The encoding mode selecting unit 1701 may select an encoding mode of bandwidth extension encoding using a frequency domain input signal and a time domain input signal.

Specifically, the encoding mode selecting unit 1701 may classify a frequency domain input signal using the frequency domain input signal and the time domain input signal, may determine the encoding mode of the bandwidth extension encoding mode, and may determine a number of frequency bands based on the determined encoding mode. Here, to improve a performance of the extension encoding unit 1702, the encoding mode may be set as a set of an encoding mode determined during core-encoding, and another encoding mode.

The encoding mode may be classified, for example, into a normal mode, a harmonic mode, a transient mode, and a noise mode. First, the encoding mode selecting unit 1701 may determine whether a current frame is a transient frame, based on a ratio of a long-term energy of the time domain input signal to a high-band energy of the current frame. A transient signal interval may refer to an interval where energy is rapidly changed in a time domain, that is, an interval where the high-band energy is rapidly changed.

The normal mode, the harmonic mode, and the noise mode may be determined as follows: First, the encoding mode selecting unit 1701 may acquire a global energy of a frequency domain of a previous frame and a current frame, may divide a ratio of the global energies and the frequency domain input signal by a frequency band defined in advance, and may determine the normal mode, the harmonic mode, and the noise mode using an average energy and a peak energy of each frequency band. The harmonic mode may provide a signal having a largest difference between an average energy and a peak energy in a frequency domain signal. The noise mode may provide a signal having a small change in energy. The normal mode may provide signals other than the signal of the harmonic mode and the signal of the noise mode.

Additionally, a number of frequency bands in the normal mode and the harmonic mode may be determined to be "16", and a number of frequency bands in the transient mode may be determined to be "5". Furthermore, a number of frequency bands in the noise mode may be determined to be "12".

The extension encoding unit 1702 may perform the bandwidth extension encoding using the frequency domain input signal and the encoding mode. Referring to FIG. 17, the extension encoding unit 1702 may include, for example, a basic signal generator 1703, a factor estimator 1704, an energy extractor 1705, an energy controller 1706, and an energy quantizer 1707. The basic signal generator 1703 and the factor estimator 1704 may perform the same functions as the basic signal generator 401 and the factor estimator 402 of FIG. 4 and accordingly, further descriptions thereof will be omitted.

The energy extractor 1705 may extract an energy corresponding to each frequency band, based on the number of frequency bands determined depending on the encoding mode. The energy controller 1706 may control the extracted energy based on the encoding mode.

The basic signal generator 1703, the factor estimator 1704, and the energy controller 1706 may be used or not be used, based on the encoding mode. For example, in the normal mode and the harmonic mode, the basic signal generator 1703, the factor estimator 1704, and the energy controller 1706 may be used, however, in the transient mode and the noise mode, the basic signal generator 1703, the factor estimator 1704, and the energy controller 1706 may not be used. Further descriptions of the basic signal generator 1703, the factor estimator 1704, and the energy controller 1706 have been given above with reference to FIG. 4.

The energy quantizer 1707 may quantize the energy controlled based on the encoding mode. In other words, a band energy passing through an energy control operation may be quantized by the energy quantizer 1707.

Figure 18:
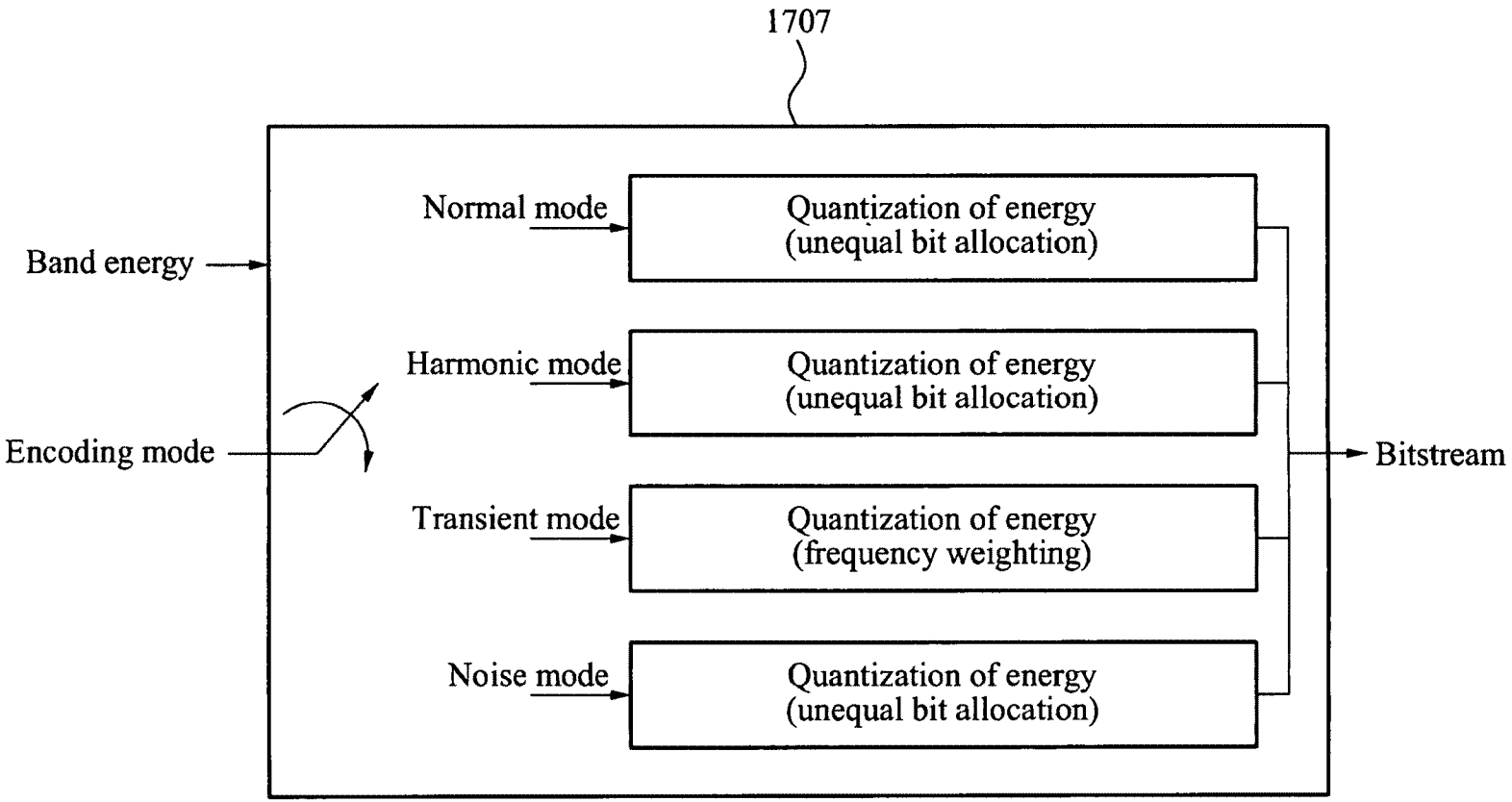
FIG. 18 illustrates a block diagram of an operation of an energy quantizer of the encoding apparatus of FIG. 17.

FIG. 18 illustrates a diagram of an operation performed by the energy quantizer 1707.

The energy quantizer 1707 may quantize an energy extracted from the frequency domain input signal, based on the encoding mode. Here, the energy quantizer 1707 may quantize a band energy using a scheme optimized for each input signal, based on perceptual characteristics of each input signal and the number of frequency bands, depending on the encoding mode.

In an example, when the transient mode is used as the encoding mode, the energy quantizer 1707 may quantize five band energies using a frequency weighting method based on the perceptual characteristics. In another example, when the normal mode or the harmonic mode is used as the encoding mode, the energy quantizer 1707 may quantize 16 band energies using an unequal bit allocation method based on the perceptual characteristics. When the perceptual characteristics are unclear, the energy quantizer 1707 may perform typical quantization, regardless of the perceptual characteristics.

Figure 19:
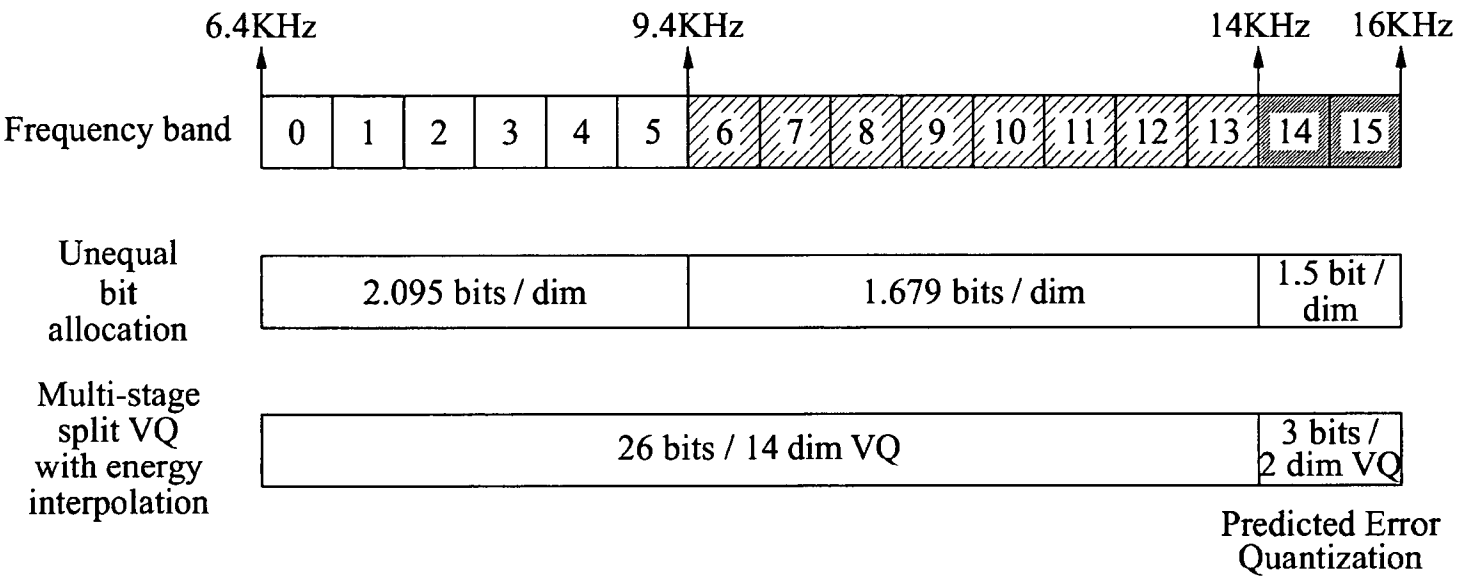
FIG. 19 illustrates a diagram of an operation of quantizing an energy using an unequal bit allocation method according to example embodiments.

FIG. 19 illustrates a diagram of an operation of quantizing an energy using the unequal bit allocation method according to example embodiments.

The unequal bit allocation method may be performed based on perceptual characteristics of an input signal targeted for extension encoding, and be used to more accurately quantize a band energy corresponding to a lower frequency band having a high perceptual importance. Accordingly, the energy quantizer 1707 may allocate, to the band energy corresponding to the lower frequency band, a number of bits that are equal to or greater than a number of band energies, and may determine the perceptual importance of the band energy.

For example, the energy quantizer 1707 may allocate a greater number of bits to lower frequency bands 0 to 5, so that a same number of bits may be allocated to the lower frequency bands 0 to 5. Additionally, as a frequency band increases, a number of bits allocated by the energy quantizer 1707 to the frequency band decreases. Accordingly, a bit allocation may enable frequency bands 0 to 13 to be quantized as shown in FIG. 19, and may enable frequency bands 14 and 15 to be quantized as shown in FIG. 20.

Figure 20:
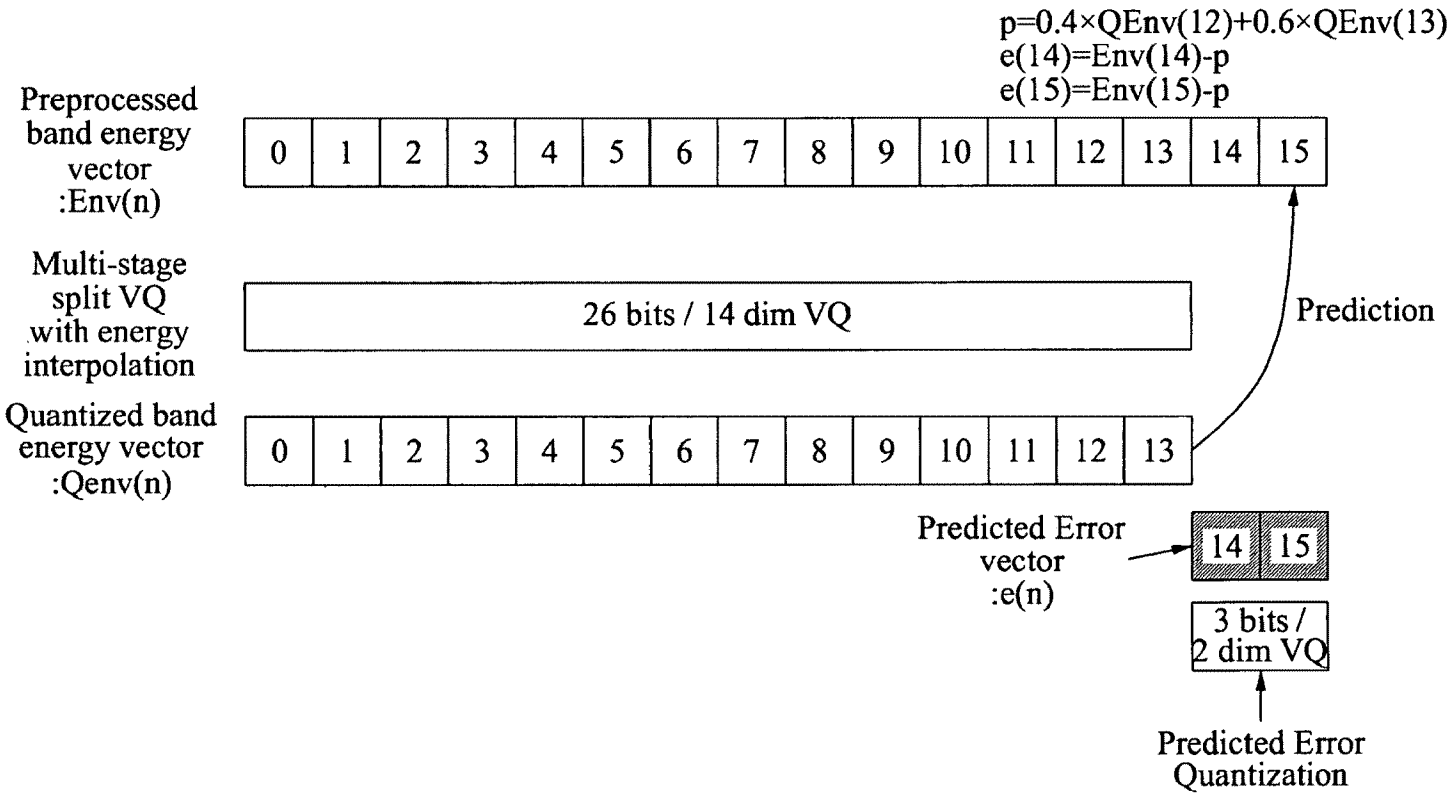
FIG. 20 illustrates a diagram of an operation of performing Vector Quantization (VQ) using intra frame prediction according to example embodiments.

FIG. 20 illustrates a diagram of an operation of performing VQ using intra frame prediction according to example embodiments.

The energy quantizer 1707 may predict a representative value of a quantization target vector having at least two elements, and may perform VQ on an error signal between the predicted representative value and at least two elements of the quantization target vector.

Such an intra frame prediction may be shown in FIG. 20, and a scheme of predicting a representative value of a quantization target vector and deriving an error signal may be represented by the following Equation 8:

[Equation 8]

$$\begin{aligned} p &= 0.4 * QEnv(12) + 0.6 * QEnv(13) \\ e(14) &= Env(14) - p \\ e(15) &= Env(15) - p \end{aligned}$$

In Equation 8, Env(n) denotes a non-quantized band energy, and QEnv(n) denotes a quantized band energy. Additionally, p denotes the predicted representative value of the quantization target vector, and e(n) denotes an error energy. Here, VQ may be performed on e(14) and e(15).

Figure 21:
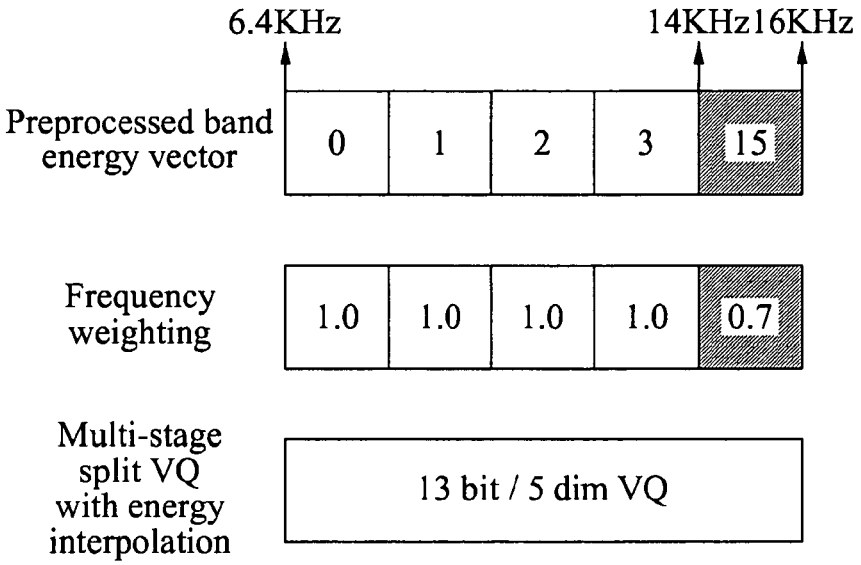
FIG. 21 illustrates a diagram of an operation of quantizing an energy using a frequency weighting method according to example embodiments.

FIG. 21 illustrates a diagram of an operation of quantizing an energy using the frequency weighting method according to example embodiments.

The frequency weighting method may be used to more accurately quantize a band energy corresponding to a lower frequency band having a high perceptual importance, based on perceptual characteristics of an input signal targeted for extension encoding, in the same manner as the unequal bit allocation method. Accordingly, the energy quantizer 1707 may allocate, to the band energy corresponding to the lower frequency band, a number of bits that are equal to or greater than a number of band energies, and may determine the perceptual importance.

For example, the energy quantizer 1707 may assign a weight of "1.0" to a band energy corresponding to frequency bands 0 to 3, namely lower frequency bands, and may assign a weight of "0.7" to a band energy corresponding to a frequency band 15, namely a higher frequency band. To use the assigned weights, the energy quantizer 1707 may obtain an optimal index using a WMSE value.

Figure 22:
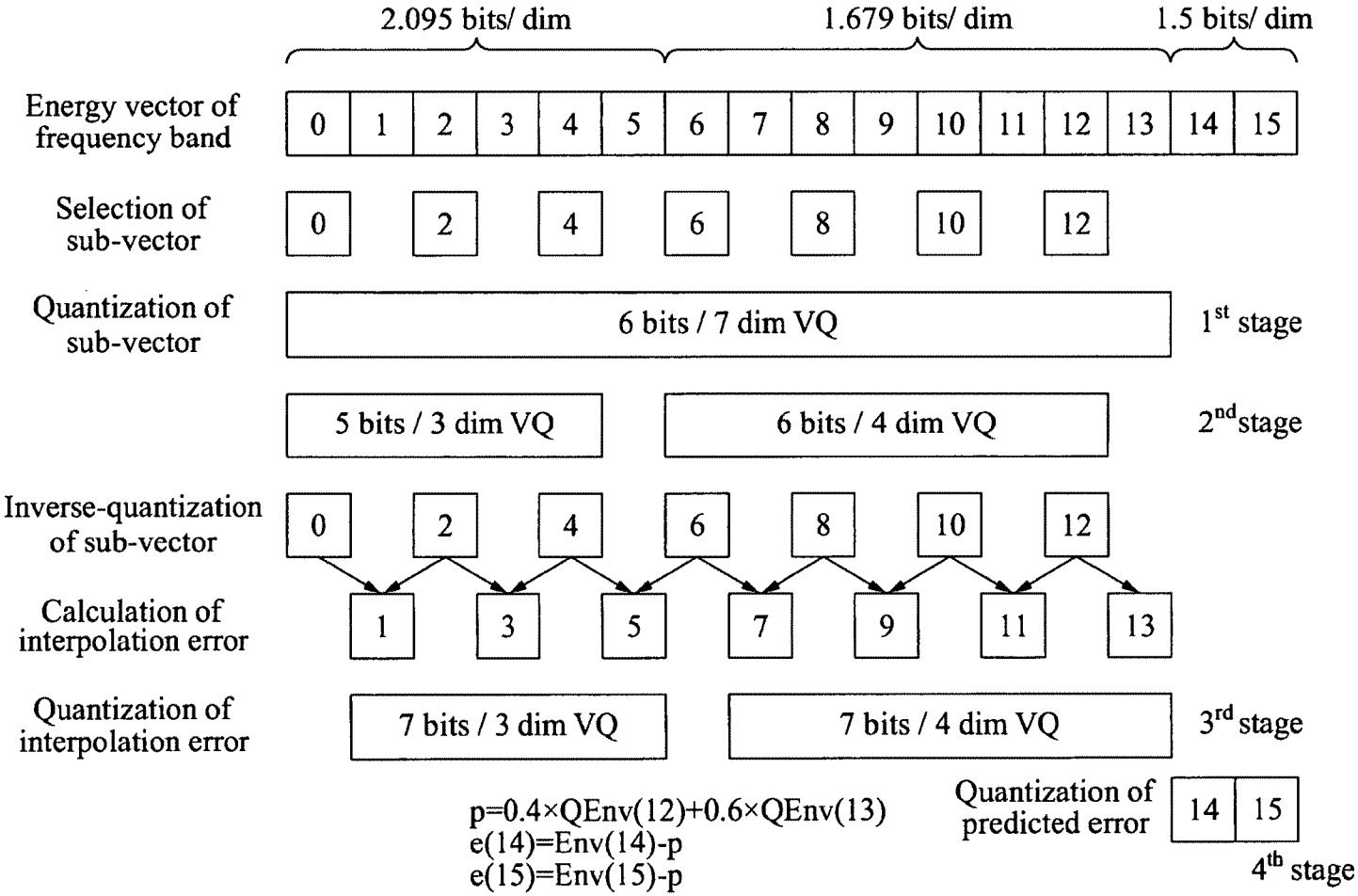
FIG. 22 illustrates a diagram of an operation of performing multi-stage split VQ, and VQ using intra frame prediction according to example embodiments.

FIG. 22 illustrates a diagram of an operation of performing multi-stage split VQ, and VQ using intra frame prediction according to example embodiments.

The energy quantizer 1707 may perform VQ on the normal mode with 16 band energies, as shown in FIG. 22. Here, the energy quantizer 1707 may perform the VQ using the unequal bit allocation method, the intra frame prediction, and the multi-stage split VQ with energy interpolation.

Figure 23:
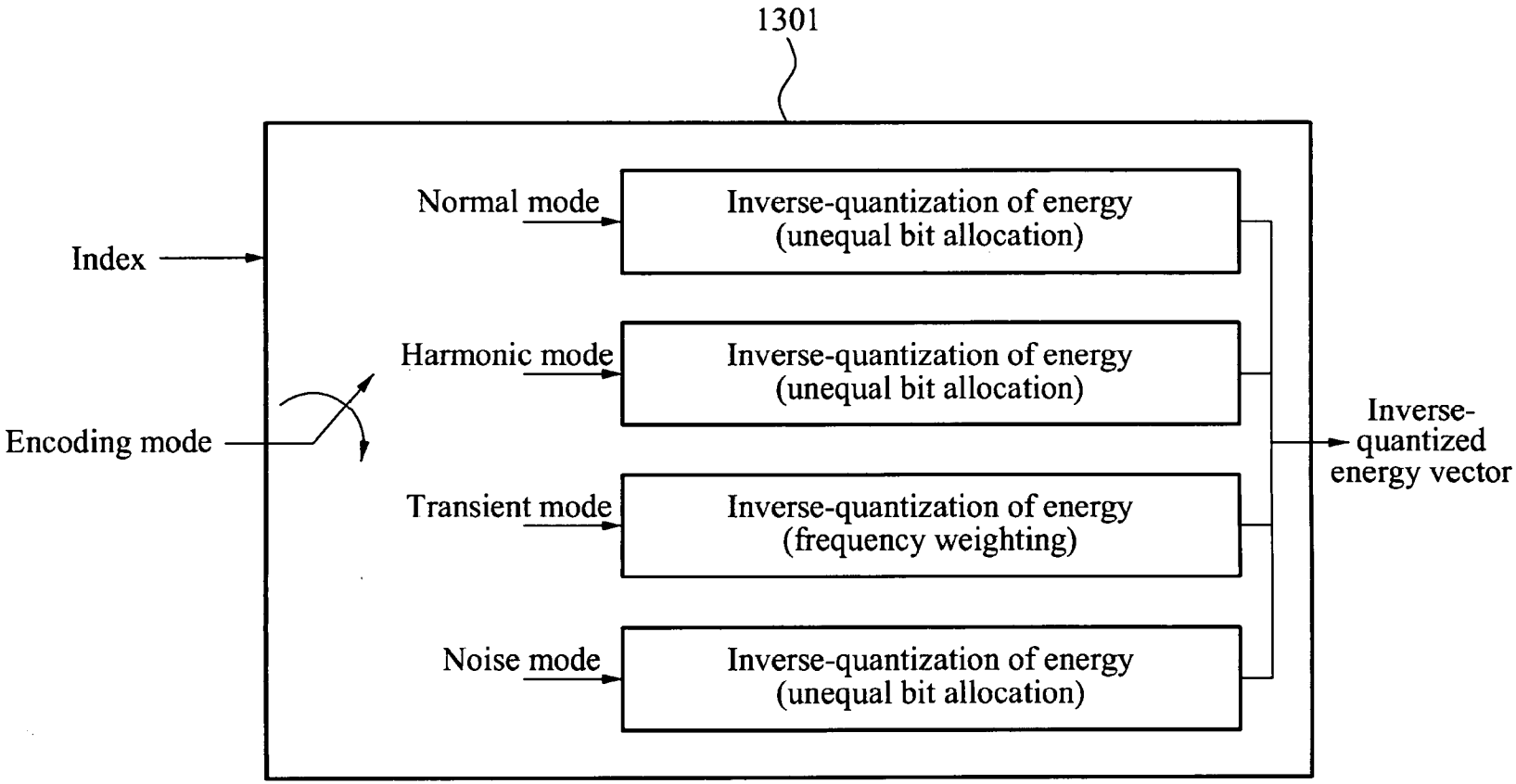
FIG. 23 illustrates a block diagram of an operation of an inverse-quantizer of FIG. 13.

FIG. 23 illustrates a diagram of an operation performed by the inverse-quantizer 1301.

The operation of FIG. 23 may be performed in an inverse manner to the operation of FIG. 18. When an encoding mode is used during extension encoding, as shown in FIG. 17, the inverse-quantizer 1301 of the extension decoding unit 1204 may decode the encoding mode.

The inverse-quantizer 1301 may decode the encoding mode using an index that is received first. Subsequently, the inverse-quantizer 1301 may perform inverse-quantization using a scheme set based on the decoded encoding mode. Referring to FIG. 23, the inverse-quantizer 1301 may inverse-quantize blocks respectively corresponding to encoding modes, in an inverse order of the quantization.

An energy vector quantized using the Multi-stage split VQ with energy interpolation may be inverse-quantized in the same manner as shown in FIG. 14. In other words, the inverse-quantizer 1301 may perform inverse-quantization using the intra frame prediction, through the following Equation 9:

[Equation 9]

$$\begin{aligned} p &= 0.4 * QEnv(12) + 0.6 * QEnv(13) \\ QEnv(14) &= \hat{e}(14) + p \\ QEnv(15) &= \hat{e}(15) + p \end{aligned}$$

In Equation 9, Env(n) denotes a non-quantized band energy, and QEnv(n) denotes a quantized band energy. Additionally, p denotes the predicted representative value of the quantization target vector, and e(n) denotes a quantized error energy.

Figure 24:
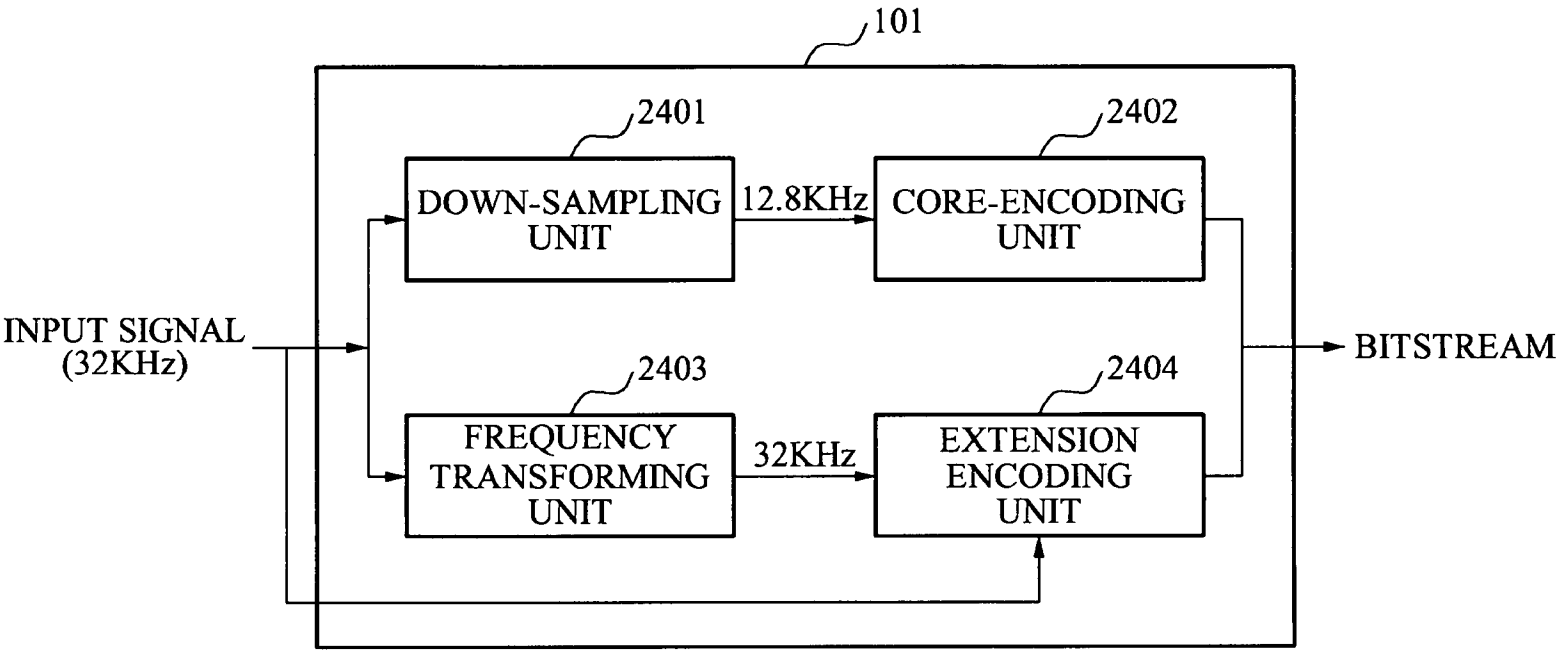
FIG. 24 illustrates a block diagram of still another example of the encoding apparatus of FIG. 1.

FIG. 24 illustrates a block diagram of still another example of the encoding apparatus 101.

The encoding apparatus 101 of FIG. 24 may include, for example, a down-sampling unit 2401, a core-encoding unit 2402, a frequency transforming unit 2403, and an extension encoding unit 2404.

The down-sampling unit 2401, the core-encoding unit 2402, the frequency transforming unit 2403, and the extension encoding unit 2404 in the encoding apparatus 101 of FIG. 24 may perform the same basic operations as the down-sampling unit 201, the core-encoding unit 202, the frequency transforming unit 203, and the extension encoding unit 204 in the encoding apparatus 101 of FIG. 2. However, the extension encoding unit 2404 need not transmit information to the core-encoding unit 2402, and may directly receive a time domain input signal.

The methods according to the above-described example embodiments may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the example embodiments, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like.

Examples of program instructions include both machine code, such as produced by a compiler, and files containing higher level code that may be executed by the computer using an interpreter. The described hardware devices may be configured to act as one or more software modules in order to perform the operations of the above-described example embodiments, or vice versa. Any one or more of the software modules described herein may be executed by a dedicated processor unique to that unit or by a processor common to one or more of the modules. The described methods may be executed on a general purpose computer or processor or may be executed on a particular machine such as the encoding apparatuses and decoding apparatuses described herein.

Although example embodiments have been shown and described, it would be appreciated by those skilled in the art that changes may be made in these example embodiments without departing from the principles and spirit of the disclosure, the scope of which is defined in the claims and their equivalents.

What is claimed is:

1. A bandwidth extension encoding method in a frequency domain, the method comprising:

generating a base excitation spectrum for a high band, based on an input spectrum;

obtaining an energy control factor of a sub-band in a frame, based on the base excitation spectrum and the input spectrum;

obtaining an energy of the sub-band in the frame from the input spectrum;

controlling the obtained energy using the obtained energy control factor, for the sub-band in the frame; and quantizing the controlled energy, wherein the controlling of the obtained energy is performed when the frame is a non-transient frame.

2. The method of claim 1, wherein the obtaining the energy control factor is based on a ratio between tonality of the base excitation spectrum and tonality of the input spectrum.

3. The method of claim 1, wherein the quantizing the controlled energy comprises quantizing the controlled energy based on a weighted mean square error (WMSE).

4. The method of claim 1, wherein the quantizing the controlled energy comprises quantizing the controlled energy based on an interpolation process.

5. The method of claim 1, wherein the quantizing the controlled energy comprises quantizing the controlled energy by using a multi-stage vector quantization.

6. The method of claim 5, wherein the quantizing the controlled energy comprises selecting a plurality of vectors from among energy vectors and quantize the selected plurality of vectors and an error obtained by interpolating the selected plurality of vectors.

7. A bandwidth extension encoding apparatus in a frequency domain, the apparatus comprising:

a processor configured:

to generate a base excitation spectrum for a high band, based on an input spectrum;

to obtain an energy control factor of a sub-band in a frame, based on a ratio between tonality of the base excitation spectrum and tonality of the input spectrum;

to obtain an energy of the sub-band in the frame, from the input spectrum;

to control the obtained energy using the obtained energy control factor, for the sub-band in the frame; and to quantize the controlled energy, wherein the controlling of the obtained energy is performed when the frame is a non-transient frame.

8. The apparatus of claim 7, wherein the processor is configured to quantize the controlled energy based on a weighted mean square error (WMSE).

9. The apparatus of claim 7, wherein the processor is configured to quantize the controlled energy based on an interpolation process.

10. The apparatus of claim 9, wherein the processor is configured to quantize the controlled energy by using a multi-stage vector quantization.

11. The apparatus of claim 7, wherein the processor is configured to select a plurality of vectors from among energy vectors and quantize the selected plurality of vectors and an error obtained by interpolating the selected plurality of vectors.

* * * * *